US006522054B2

(12) United States Patent
Shibata

(10) Patent No.: US 6,522,054 B2
(45) Date of Patent: Feb. 18, 2003

(54) ELECTRON-EMITTING DEVICE, ELECTRON SOURCE AND IMAGE FORMING APPARATUS

(75) Inventor: Masaaki Shibata, Ninomiya-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/435,818

(22) Filed: Nov. 8, 1999

(65) Prior Publication Data

US 2002/0084736 A1 Jul. 4, 2002

(30) Foreign Application Priority Data

Feb. 26, 1999 (JP) ..... 11-049382
Oct. 26, 1999 (JP) ..... 11-303336

(51) Int. Cl.[7] ..... H01J 1/13; H01J 1/14; H01J 19/04; H01J 19/02

(52) U.S. Cl. ..... 313/310; 313/495; 313/311; 313/346 R; 313/496

(58) Field of Search ..... 313/309, 310, 313/494, 495, 496, 336, 351

(56) References Cited

U.S. PATENT DOCUMENTS

| | | | | |
|---|---|---|---|---|
| 5,960,317 A | * | 9/1999 | Jeong | 438/633 |
| 6,005,540 A | * | 12/1999 | Shinjo et al. | 313/309 |
| 6,048,672 A | * | 4/2000 | Cameron et al. | 430/327 |
| 6,114,043 A | * | 9/2000 | Joret | 428/428 |
| 6,184,610 B1 | | 2/2001 | Shibata et al. | 313/309 |
| 6,334,803 B1 | | 1/2002 | Shibata | 445/51 |

FOREIGN PATENT DOCUMENTS

| | | | | |
|---|---|---|---|---|
| EP | 0915493 | * | 5/1999 | 313/309 |
| JP | 2630983 | | 4/1997 | |
| JP | 9-274195 | | 6/1998 | |
| JP | 10-188854 | | 7/1998 | |
| JP | 10-241550 | | 9/1998 | |
| JP | 2836015 | | 10/1998 | |
| JP | 2903295 | | 3/1999 | |

OTHER PUBLICATIONS

W.P. Dyke & W.W. Dolan, "Field Emission," Advances in Electronics and Electron Physics, vol. 8, 89 (1956) ( no month).

C.A. Spindt, et al., "Physical Properties of Thin–Film Field Emission Cathodes with Molybdenum Cones," J. Appl. Phys., vol. 47, 5248 (Dec. 1976).

C.A. Mead, "Operation of Tunnel–Emission Devices," J. Appl. Phys. vol. 32, 646 (Jan. 1961).

* cited by examiner

*Primary Examiner*—Nimeshkumar D. Patel
*Assistant Examiner*—Mariceli Santiago
(74) *Attorney, Agent, or Firm*—Fitzpatrick, Cella, Harper & Scinto

(57) ABSTRACT

An electron-emitting device comprising a substrate, first and second carbon films disposed on the substrate, and first and second electrodes electrically connected to the first and second carbon films, respectively. The first and second carbon films are opposed to each other with a first gap interposed therebetween, and a portion of the substrate located between the electrodes comprises at least Si, O and N.

11 Claims, 20 Drawing Sheets

ELECTRON-EMITTING DEVICE, ELECTRON SOURCE AND IMAGE FORMING APPARATUS

BACKGROUND OF THE INVENTION

1. Field of the Invention

The present invention relates to an electron-emitting device, an electron source and an image forming apparatus such as a display apparatus to which the electron-emitting device and the electron source are applied.

2. Related Background Art

There have conventionally known two kinds of electron-emitting devices, such as thermonic cathode and cold-cathode.

The cold-cathode are classified into a field emission type (hereinafter abbreviated as FE type), a metal/insulating layer/metal type (hereinafter abbreviated as MIM type) and so on.

Known as examples of the FE type are those reported by W. P. Dyke & W. W. Dolan, "Field emission" Advance in Electron Physics, 8, 89 (1956) and C. A. Spindt, "Physical Properties of thin-film field emission cathodes with molybdenum cones," J. Appl. Phys., 47, 5248 (1976)

Known as an example of the MIM type is that reported by C. A. Mead, "Operation of Tunnel-Emission Devices.," J. Appl. Phys. 32, 646 (1961).

Examples of the surface conduction type electron-emitting device are disclosed, for example, by Japanese Patent Nos. 2903295 and 2836015. The patent specifications mentioned above disclose device which have been formed may be subjected to a treatment which is referred to as an activation treatment. An. activation treatment step is a step to remarkably vary a device current If and an emission current Ie.

FIGS. 18A and 18B are a plan view and a sectional view of a surface conduction type electron-emitting device such as those disclosed by the specifications mentioned above. In FIGS. 18A and 18B, a reference numeral 1 denotes an insulating substrate, reference numeral 2 and 3 denote electrodes, a reference numeral 4 denotes an electrically conductive film, a reference numeral 5 denotes electron-emitting region, a reference numeral 6 denotes second gaps which are formed by a forming step, a reference numeral 7 denotes a first gap which is formed by the activation treatment step, and a reference numeral 10 denotes carbon films which are formed by the activation treatment step.

Like the forming step, the activation treatment step can be carried out by repeatedly applying a pulse voltage to a device in an atmosphere containing an organic substance. By this treatment, carbon films composed of carbon or a carbon compound is deposited onto at least the electron-emitting region of the device from the organic substance existing in the atmosphere. As a result, the carbon films remarkably varies a device current (If) running between the electrodes 2 and 3 as well as an emission current (Ie) emitted from the electron-emitting region, thereby making it possible to obtain a more favorable electron emission characteristic.

An image forming apparatus can be configured by combining an electron source substrate on which a plurality of such electron-emitting devices are formed with an image forming member composed of a fluorescent substance or the like.

Japanese Patent No. 2630983, Japanese Patent Application Laid-Open No. 10-188854, Japanese Patent Application Laid-Open No. 10-241550, etc. disclose that a glass substrate which is composed, for example, of quartz glass, high silica glass (Vycor), non-alkali glass, borosilicate glass (Pyrex), soda lime glass or soda lime glass laminated with $SiO_2$ is usable as an insulating substrate on which the surface conduction type electron-emitting device is to be formed.

SUMMARY OF THE INVENTION

It is considered that a surface of the insulating substrate 1 which is located in the vicinity of the electron-emitting region is heated to a considerably high temperature during the activation treatment of the surface conduction type electron-emitting device and driving of the device.

According to examinations which were made by the applicant of the present application et al., it is estimated that the vicinities of the electron-emitting region in particular are heated to a high temperature on the order of 1000 K during the activation treatment.

Accordingly, at least the surface of the insulating substrate 1 must be free from remarkable variations of physical properties, for example, a variation of the surface due to heat distortion and thermal expansion. Meant by the surface of the insulating substrate 1 is a range which is influenced by the temperature of the electron-emitting region.

From a viewpoint described above, the substrates mentioned above such as quartz glass and high silica glass are usable preferably as the insulating substrate 1. However, these glass materials are expensive and not adequate to manufacture an image forming apparatus or an electron source. Furthermore, it is difficult to facilitate to bond these glass materials with frit glass or the like in an attempt to form a vacuum vessel by using these glass materials.

When a soda lime glass which is inexpensive is used, on the other hand, it reaches a temperature exceeding a strain point at the time of the activation treatment due to temperature rise of the vicinities of the electron-emitting region. The soda lime glass is also expanded remarkably by heat. Therefore, a surface shape of the soda lime glass is remarkably varied.

When a large number of surface conduction type electron-emitting devices are actually formed on soda lime grass, variations of device characteristics caused at the activation step and driving step are remarkable as compared with those which are caused when the electron-emitting device are formed on a quartz substrate. Furthermore, an obtained electron emission characteristic is also low as compared with that when the electron-emitting devices are formed on the quartz substrate.

It is considered that a main reason for this defect is the variation of the surface shape which is caused due to the high temperature produced locally in the vicinity of the electron-emitting region.

That is, it is considered that an effective voltage or electric field applied to the first gap being formed is different from device to device due to the variation of the surface shape of the substrate, thereby causing the variations at the activation step. When a pulse like voltage is applied repeatedly at the activation step in particular, a temperature rise and a temperature drop are recreated as the pulse like voltage is turned on and off. It is therefore assumed that the repeated temperature rise and temperature drop result in difference in shapes of the carbon films and the first gap, thereby causing the variations of electron emission characteristics (If and Ie) obtained at the activation step.

Furthermore, it is considered that the variations caused at the driving step is, like the variations at the activation step, due to the variations with time of the effective voltage or electric field applied to the first gap.

Dependently on a material of the substrate which is in contact with the surface conduction type electron-emitting device, the device characteristics may be varied not only at a manufacturing step but also at the driving step of the devices.

In view of the problems described above, the present invention provides a surface conduction type electron-emitting device which maintains a favorable electron emission characteristic stably for a long time, and an electron source and an image forming apparatus which are inexpensive, and have favorable and highly uniform electron emission characteristics.

Then, the present invention has been achieved on the basis of examinations which were made eagerly to solve the problems described above.

Speaking concretely, the present invention provides an electron-emitting device having a configuration wherein first and second carbon films are formed on a substrate with a first gap interposed, a first and second electrodes are electrically connected to the carbon films respectively, and the substrate disposed at least in the first gap comprises Si, O and N, thereby having a favorable electron emission characteristic which is stable for a long time.

The electron-emitting device according to the present invention is further characterized in that the substrate disposed in the first gap comprises a compound of Si, O and N, and that the compound is oxynitride glass.

Furthermore, the electron-emitting device according to the present invention is characterized in that the substrate is a glass substrate on which a layer of oxynitride glass is formed.

Furthermore, the electron-emitting device according to the present invention is characterized in that the layer of oxynitride glass has a thickness of 1 $\mu$m or larger.

Furthermore, the electron-emitting device according to the present invention is characterized in that a layer having a main component of silica is disposed on a surface of the layer composed of oxynitride glass.

Moreover, the electron-emitting device according to the present invention is characterized in that the layer having the main component of silica further comprises phosphorus.

Moreover, the electron-emitting device according to the present invention is characterized in that the layer having the main component of silica has a thickness of 40 nm or larger.

In addition, another embodiment of the present invention is an electron source in which the electron-emitting device described above is disposed in a large number.

In addition, still another embodiment of the present invention is an image forming apparatus which comprises the electron source and an image forming member.

The electron source according to the present invention described above is an electron source which emits electrons in correspondence to an input signal and in which the electron-emitting device according to the present invention is disposed in a plurality on a substrate, preferably characterized in that the electron source comprises a plurality of rows of electron-emitting devices each having ends connected to wiring and a modulation means. More preferably, the electron source according to the present invention is characterized in that arranged on the substrate are a plurality of electron-emitting devices each having a pair of electrodes connected to m wires in an X direction and n wires in a Y direction which are electrically insulated from each other.

Furthermore, the image forming apparatus according to the present invention is an apparatus which forms an image on the basis of an input signal and is characterized by comprising an image forming member and the electron source according to the present invention. By using the image forming apparatus, it is possible to configure a display apparatus for TV broadcasting which comprises an image forming apparatus.

The electron-emitting device according to the present invention which uses the oxynitride glass which has a high thermal stability an a portion of the substrate is capable of suppressing a characteristic of the device from being influenced by a variation of a shape of the substrate due to a temperature rise at both the activation treatment and driving steps described above, thereby maintaining a favorable and stable electron emission characteristic for a long time.

Furthermore, the electron source and image forming apparatus according to the present invention are capable of maintaining stable and high uniformity electron emission characteristic and image displaying characteristic for a long time.

DETAILED DESCRIPTION OF THE PREFERRED EMBODIMENTS

Figure 1A:
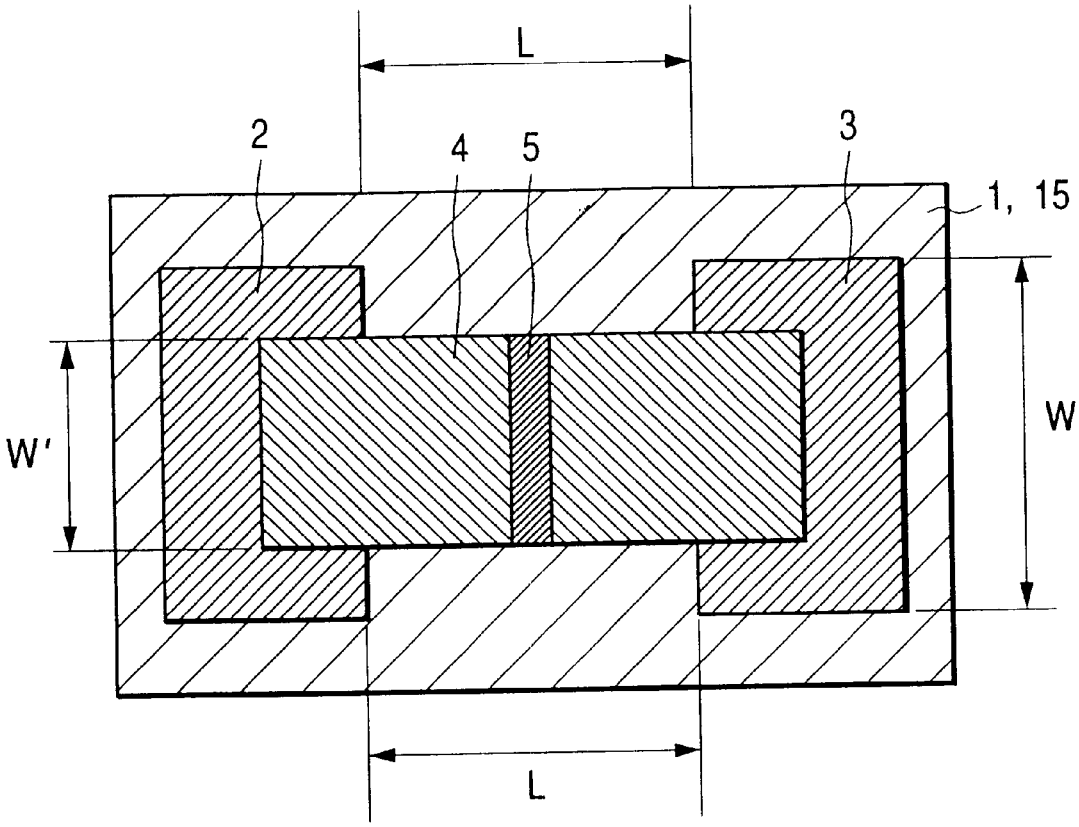
FIGS. 1A and 1B are diagrams showing a configuration of a basic surface conduction type electron-emitting device according to the present invention.

Now, a preferable embodiment of the present invention will be described below:

First, description will be made of a basic configuration of the electron-emitting device according to the present invention.

FIGS. 1A, 1B and FIGS. 19A and 19B are plan views and sectional views respectively showing a configuration of a planar type surface conduction type electron-emitting device according to the present invention. An electron-emitting region 5 is illustrated in more detail in FIGS. 19A and 19B than in FIGS. 1A and 1B. In FIGS. 1A, 1B, 19A and 19B, a reference numeral 1 denotes a glass substrate, reference numerals 2 and 3 denote device electrodes, a reference numeral 4 denotes a pair of thin electrically conductive films, a reference numeral 5 denotes the electron-emitting region, a reference numeral 10 denotes a pair of carbon films, a reference numeral 6 denotes second gaps between the thin electrically conductive films, a reference numeral 7 denotes a first gaps between the carbon films, and a reference numeral 15 denotes a layer which comprises Si, O and N. The electrically conductive films 4 are not always necessary as described later in detail.

Figure 19A:
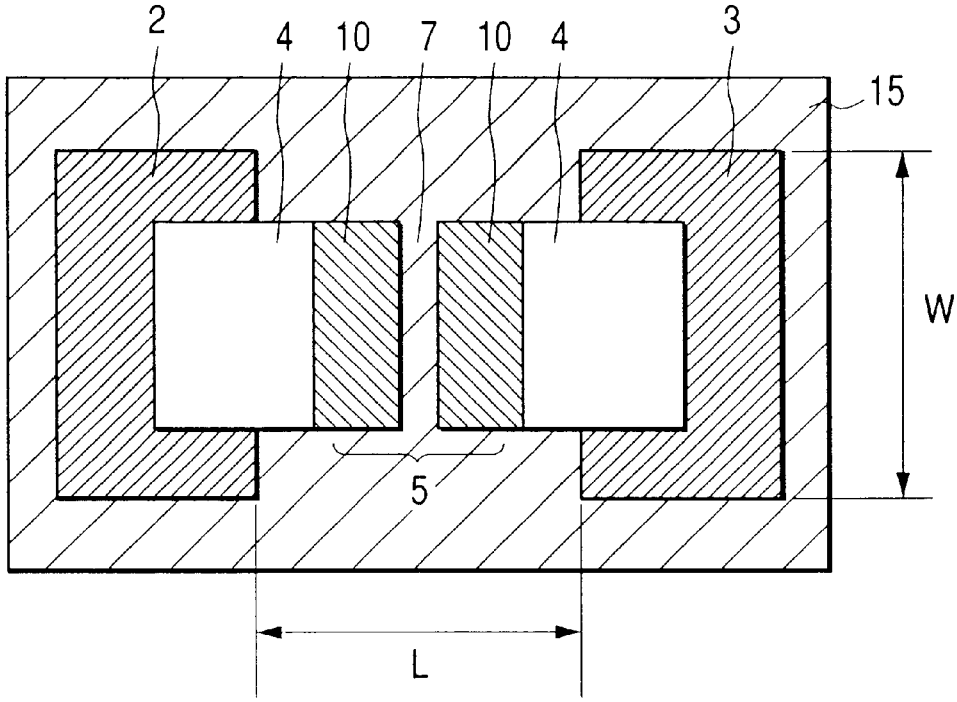
FIGS. 19A and 19B are schematic diagrams showing a configuration of the electron-emitting device according to the present invention.
Figure 19B:
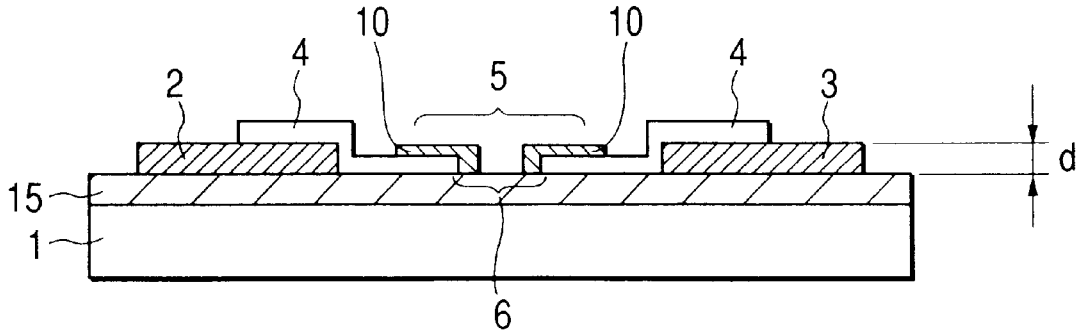

In FIGS. 19A and 19B, the carbon films 10 and the electrically conductive thin films are shown in conditions where the films are separated completely by the first gaps 7 and the second gap 6. However, these films may not necessarily separated completely as shown in these drawings. In other words, it can be said that the electron-emitting device has a condition where the first gaps is formed in a portion of the carbon film 10 which electrically connects a pair of electrodes. That is, the pair of carbon films may be continuous in a minute area so far as the electron-emitting device exhibits a sufficient electron characteristic. Accordingly, the configuration of the electron-emitting device according to the present invention is characterized in that the carbon films 10 which are opposed to each other with the gap 7 interposed are formed on one and the same substrate.

Speaking concretely, a layer 15 which comprises Si, O and N is composed of a compound of Si, O and N. Speaking more concretely, the layer 15 is composed of a layer of oxynitride glass.

Though FIGS. 1A, 1B, 19A and 19B show an example where the layer 15 which comprises Si, O and N is formed on the glass substrate 1, the substrate itself (1 and 15) may be composed of the oxynitride glass.

Though the layer 15 is arranged all over the glass substrate for manufacturing convenience, the present invention is not limited by this arrangement of the layer 15. Speaking concretely, it is preferable that the layer which comprises Si, O and N occupies a surface portion of the substrate at a location at least within the first gap. Furthermore, it is preferable that the layer occupies a surface portion of the substrate at a location within the second gap. So far as the layer 15 occupies the surface portion of the substrate at the location between the electrodes, the electron-emitting device according to the present invention can exhibit a sufficient effect.

Various kinds of glass materials can be used for the glass substrate 1. There can be mentioned, for example, soda-lime glass, potassium-substituted glass obtained by substituting sodium for potassium in the soda lime glass and alkali mixture glass which contains a mixture of plural kinds of alkali metals. It is preferable to use the soda lime glass which is inexpensive.

Any electrically conductive substance is usable as a material for the device electrodes which are opposed to each other, and it is possible to adequately select, for example, from among metals and alloys such as Ni, Cr, Au, Mo, W, Pt, Ti, Al, Cu and Pd, printing conductors composed of metals or metal oxides such as Pd, Ag, Au, $RuO_2$, Pd—Ag and glass, transparent conductors such as $In_2O_3$—$SnO_2$, and semiconductor materials such as polysilicon.

A gap L between the device electrodes, a length W of the device electrodes, a shape of the electrically conductive thin films 4, etc. are designed adequately dependently on a manner of application of the device and so on, for example, as sizes of pixels corresponding to a screen size for a display apparatus such as a TV described later and must be highly precise for a high definition TV which has a small pixel size in particular. The gap, length and the shape are designed so as to obtain a sufficient emission current so that luminance is sufficiently high under a restriction imposed on a size of the electron-emitting device.

The gap L between the device electrodes is set at several scores of nanometers to several hundred micrometers, preferably at several to scores of micrometers, dependently on a photolithography technique as a basis of manufacturing method for the device electrodes, that is, performance of an exposure apparatus and etching method as well as a voltage to be applied across the device electrodes.

When the gap between the device electrodes is formed by an FIB (focused ion beam) method, it permits controlling the gap on the order of nanometers. It is therefore possible to connect the electrodes 2 and 3 directly to the carbon films 10 without forming the electrically conductive thin films 4 described above.

Accordingly, it is sufficient for the electron-emitting device according to the present invention that the carbon films (10) are electrically connected to the electrodes (2 and 3). In the case where the electrically conductive films are omitted as described above, the second gap mentioned above corresponds to the gap (L) between the electrodes (2 and 3).

The length W and a thickness d of the device electrodes are adequately designed dependently on a resistance value of the electrodes, connections to the X and Y wires described above and arrangement of the electron source disposed in a large number: the length W of the device electrode being is usually several micrometers to several hundred micrometers and the thickness d of the device electrodes (2 and 3) is several nanometers to several micrometers.

The electron-emitting device can have not only the configuration shown in FIG. 1 but also a configuration wherein the layer 15, the electrically conductive thin films 4, and the device electrodes 2 and 3 which are opposed to each other are laminated in this order on the substrate 1. A thickness of the electrically conductive films 4 is adequately designed taking step coverage over the device electrodes 2 and 3, a resistance value between the device electrodes 2 and 3, forming conditions described later, etc. into consideration. Since a thermal stability of the electrically conductive thin films 4 is an important parameter which governs a life of the electron-emitting device, it is generally desirable to use a material which has a high melting point for the electrically conductive films 4. However, it is usual that electroforming which is described later is harder and a larger amount of electric power is required to form the electron-emitting region as the electrically conductive thin films 4 have a higher melting point. Furthermore, the high melting point may pose a problem related to an electron emission characteristic that an application voltage which causes electron emission (threshold voltage value) is enhanced dependently on an obtained form of the electron-emitting region.

The electron-emitting device according to the present invention does not require a material for the electrically conductive thin films 4 which has a high melting point in particular, but enables to select a material and a form which permit obtaining favorable electron-emitting region at a relatively low forming power. As an example of material which satisfies the requirement described above, it is preferable to use an electrically conductive material such as Ni, Au, PdO, Pd or Pt and form the material into a film having a thickness which exhibits a resistance value of Rs (sheet resistance) from $10^2$ to $10^7$ Ω/□. Rs is a value which is obtained when resistance R of a thin film which has a thickness t, a width w and a length l is expressed as R=Rs(1/w) and is equal to ρ/t when resistivity is represented by ρ. A film thickness which exhibits the resistance mentioned above is within a range approximately from 5 nm to 50 nm.

Out of the materials exemplified above, PdO is preferable from viewpoints that it can easily be formed into a film by baking it in an atmosphere of an organic Pd compound, that it is a semiconductor which has a relatively low electric conduction and has a broad process margin to obtain a resistance value Rs within the range mentioned above, and that it can easily be reduced into metal Pd after forming the electron-emitting region, thereby reducing film resistance. However, the electron-emitting device according to the present invention can exhibits its effect even when the electrically conductive films are made of PdO or the other material mentioned above.

In addition, the carbon films 10 are made of carbon which is mainly of graphite.

When oxynitride glass is used as the layer 15 which comprises Si, O and N, it is composed of glass having a main component of silicon oxi-nitride which is silica glass wherein a portion of oxygen is substituted for nitrogen.

It is desirable to prevent crystallization of the oxynitride glass so that the electron-emitting device according to the present invention has a desired glass property. Concretely speaking, it is preferable to add nitrogen within a range not lower than 1 atom % and not higher than 20 atom % relative to $SiO_2$ glass (Si; 33 atom %,:O; 67 atom %). Furthermore, it is preferable in particular to add nitrogen within a range not lower than 5 atom % and not higher than 20 atom %. It is therefore preferable that oxynitride has a composition of 33 atom % of Si, 47 atom % of O and 20 atom % at highest of N.

On the other hand, a portion of Si may be substituted for another metal element. In such a case, it is desirable to substitute Si in oxynitride at a ratio not exceeding 10% of its atom %.

Accordingly, oxynitride preferably applicable to the electron-emitting device according to the present invention has a composition from SiON (Si: 33 atom %, O: 66 atom % and N: 1 atom %) to SiMON (Si: 30 atom %, M: 3 atom %, O: 47 atom % and N: 20 atom %, wherein M is a metal element other than Si).

The activation process described above may be insufficient at a higher content of N.

An alkali metal, an alkali earth metal, a rare earth or aluminium or the like can be used as the metal element (M) which substitutes for the portion of Si.

The thickness of the layer 15 is set so as to prevent temperature from being conducted from the electron-emitting region 5 to the glass substrate 1. Concretely speaking, it is preferable that the layer 15 has a thickness not smaller than 1 μm.

A method which thermally treats $SiO_2$ glass in an atmosphere containing nitrogen, a gas phase growing method or a sol-gel method can be used when the oxynitride glass described above is to be used as the layer 15.

The layer 15 separates the electron-emitting region 5 from the glass substrate 1 in the electron-emitting device according to the present invention as described above, thereby being capable of reducing the variations due to thermal deformation of the glass substrate. Accordingly, the electron-emitting device according to the present invention can exhibit favorable electron emission characteristic which is stable for a long time.

Figure 2A:
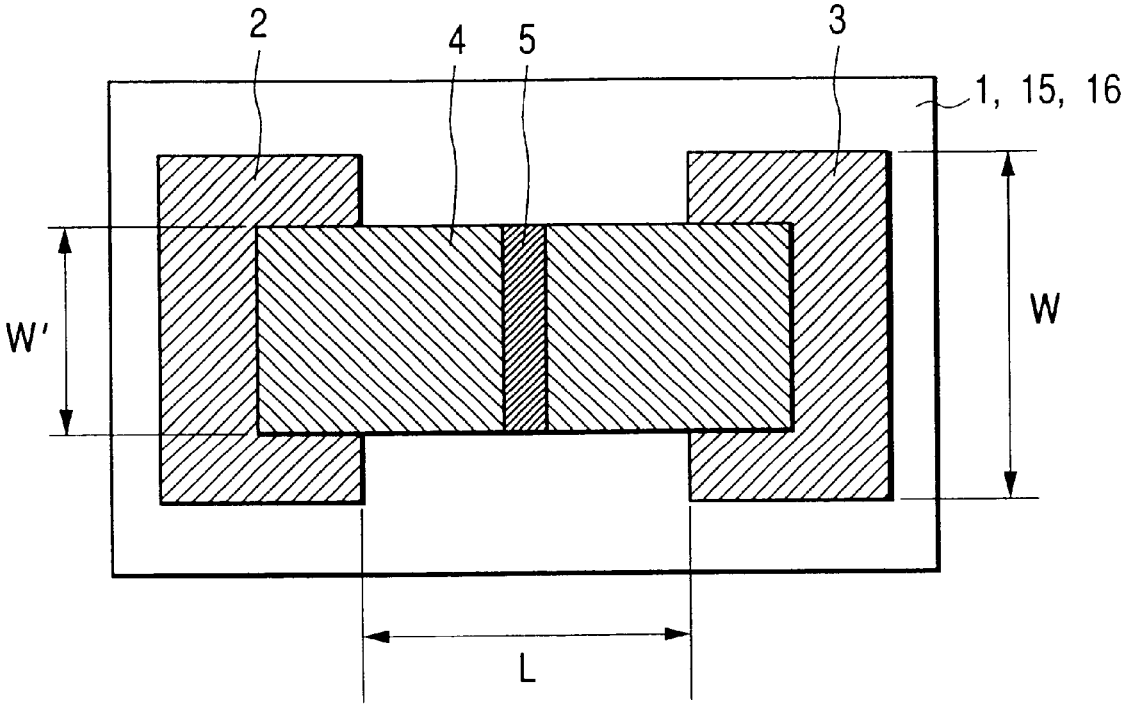
FIGS. 2A and 2B are diagrams showing another embodiment of the basic electron-emitting device according to the present invention.
Figure 2B:
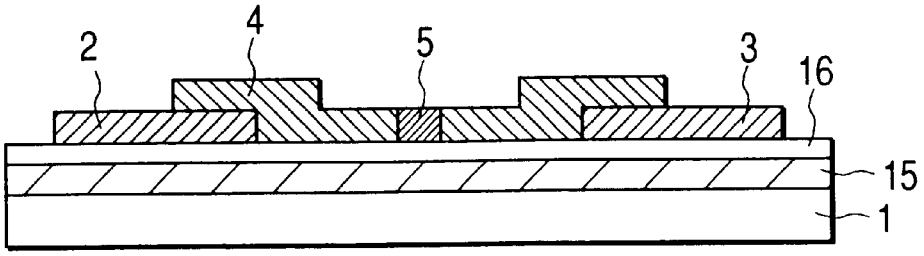

When the layer (oxynitride glass layer) 15 has a high content of nitrogen, it may retard the activation process. In such a case, a favorable electron emission characteristic can be obtained by forming a layer 16 having a main component of silica on the layer 15 as shown in FIGS. 2A and 2B. Not only a layer which is composed only of silica but also layer which contains phosphorus (for example, doped with phosphorus) may be used as the layer 16 which has the main component of silica.

The layer 16 may be used adequately to match thermal expansion coefficients of the glass substrate 1 and the layer 15 with that of the element.

The layer 16 which has the main component of silica may be as thick as possible and exhibits a remarkable effect when it has a thickness of 40 nm or larger.

Now, description will be made of a vertical surface conduction type electron-emitting device according to the present invention which has a different configuration.

Figure 3:
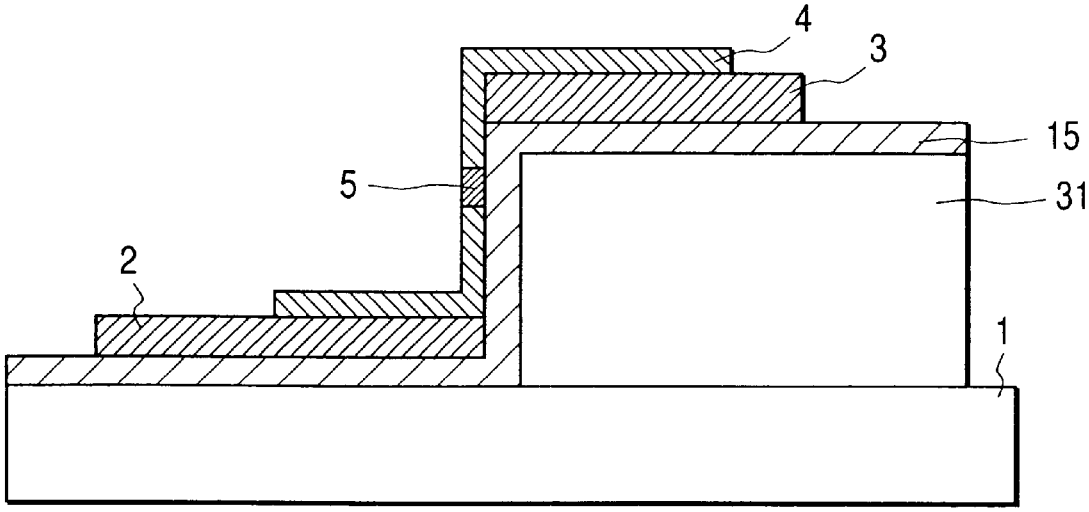
FIG. 3 is a diagram showing still another embodiment of the basic electron-emitting device according to the present invention.

FIG. 3 is a schematic diagram showing the configuration of a vertical type surface conduction type electron-emitting device.

Figure 1B:
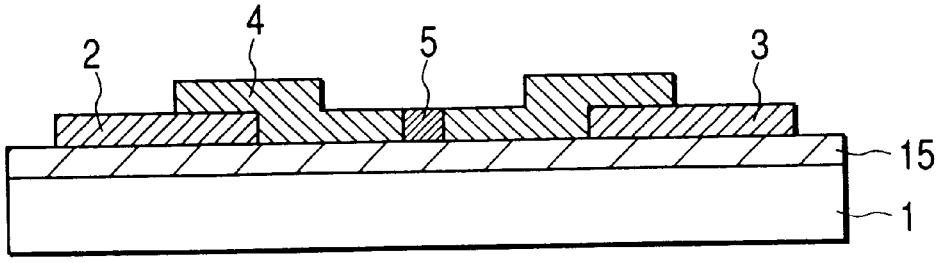

In FIG. 3, members which are the same as those shown in FIGS. 1A and 1B are denoted by the same reference numerals. A reference numeral 31 denotes a step forming member. The device electrodes 2 and 3, the electrically conductive thin film 4, the electron-emitting region 5, and the layer 15 (oxynitride glass layer) 15 which comprises Si, O and N are made of the materials which are similar to those of the planar type surface conduction type electron-emitting device which has been already described above. The step forming member 31 is composed on an insulating material such as $SiO_2$ by a vacuum deposition method, printing method, sputtering method or the like. A thickness of the step forming member 31 corresponds to the gap between the device electrodes described above and is tens of several nanometers to tens of several micrometers. Though this thickness is determined dependently on a manufacturing method of the step forming member, a voltage to be applied across the device electrodes, a voltage for causing electron emission and so on, it is preferable that the thickness is within a range from several nanometers to several micrometers.

Furthermore, the step forming member 31 may be formed as the layer (oxynitride glass layer) 15 which comprises Si, O and N. In such a case, it is needless to say that the effect of the present invention can be obtained without forming the layer 15 shown in FIG. 3.

Figure 4:
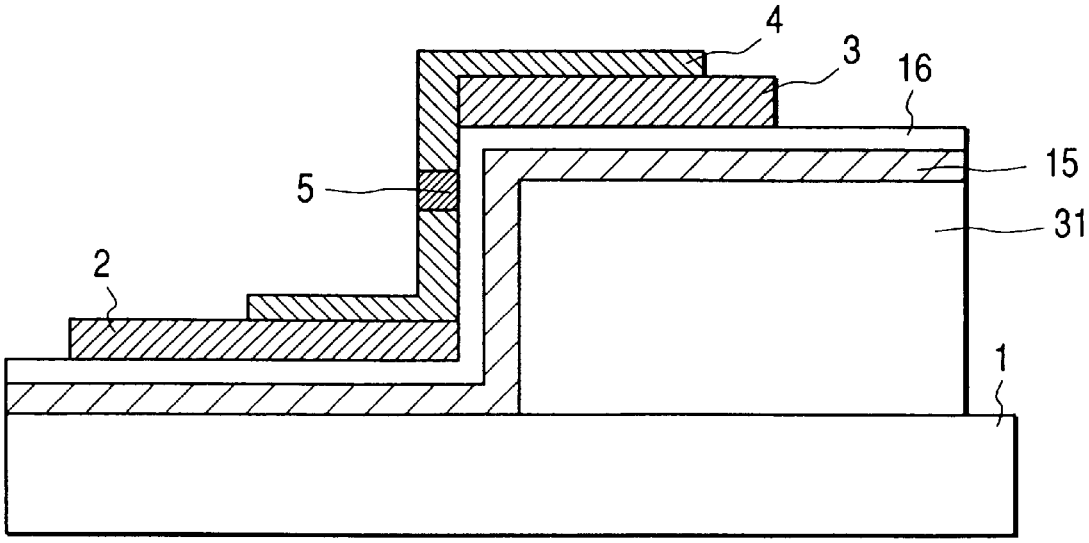
FIG. 4 is a diagram showing a further embodiment of the basic electron-emitting device according to the present invention.

Furthermore, a silica layer 16 can be formed on the layer (oxynitride glass layer) 15 which comprises Si, O and N as shown in FIG. 4 as in the planer type surface conduction type electron-emitting device.

Out of various manufacturing methods of the electron-emitting device which has the electron-emitting region 5, an example is shown in FIGS. 5A through 5D and 20A through 20E. FIG. 20A through 20E show steps to form the electron-emitting region 5 in more detail.

The manufacturing method will be sequentially described below with reference to FIGS. 1A, 1B, 19A, 19B and FIGS. 5A through 5D, FIGS. 20A through 20E.

Figure 5A:
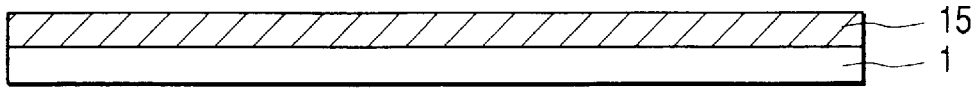
FIGS. 5A, 5B, 5C and 5D are diagrams descriptive of a basic manufacturing method of the surface conduction type electron-emitting device according to the present invention.
Figure 20A:
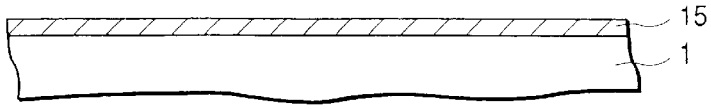
FIGS. 20A, 20B, 20C, 20D and 20E are schematic diagrams showing processes to manufacture the electron-emitting device according to the present invention.

1) After the glass substrate 1 is washed sufficiently with a detergent, pure water and an organic solvent, the oxynitride glass layer 15 is formed by the sol-gel method or the like ((FIGS. 5A and 20A). The oxynitride glass layer may be formed not by the sol-gel method but by a CVD method or the like. An oxynitride layer 6 may be formed by preliminarily forming a layer which has a main component of silica and then nitriding this layer.

Furthermore, the silica layer may be coated over the oxynitride glass layer 15 as described above.

Figure 5B:
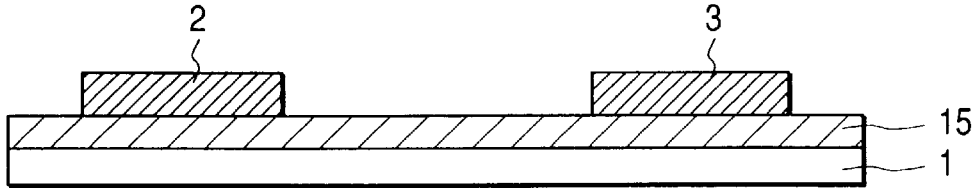
Figure 20B:
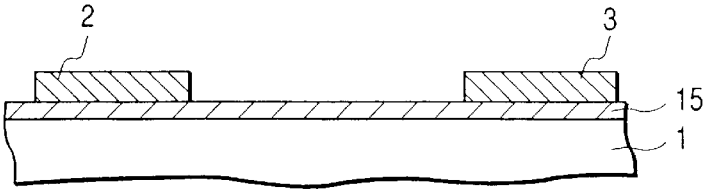

2) Successively, a device electrode material is deposited by the vacuum deposition method, sputtering method or the like, on the oxynitride glass layer 15 formed on the substrate 1, and the device electrodes 2 and 3 are formed by the photolithography technique (FIGS. 5B and 20B).

Figure 5C:
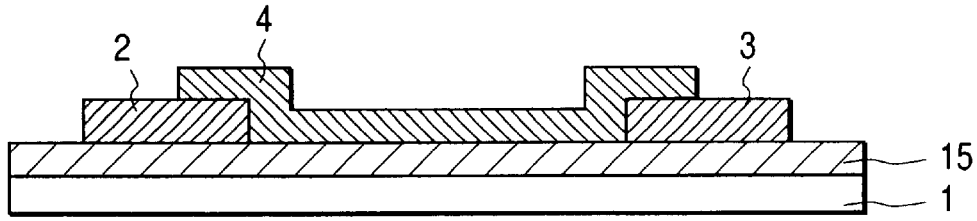
Figure 20C:
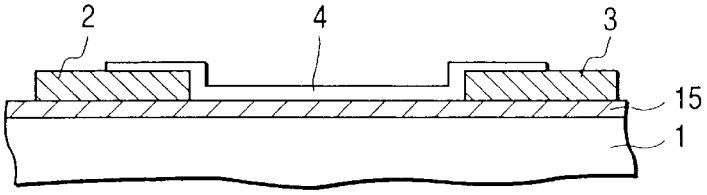

3) An organic metal film is formed between the device electrodes 2 and 3 disposed on the substrate 1 where the oxynitride glass layer 15 is formed by coating and drying an organic metal solution. The organic metal solution is a solution of the organic metal compound having a main component of a metal such as Pd, Ni, Au or Pt mentioned above. Thereafter, the electrically conductive films 4 are formed by baking the organic metal film for baking treatment and patterning the organic metal film by liftoff etching or the like (FIGS. 5C and 20C). Though the organic metal solution is coated to form the electrically conductive thin films 4 in the above description, this method is not limitative and the thin films may be formed by the vacuum deposition method, sputtering method, CVD method dispersive coating method, dipping method, spinner method ink-jet method or the like.

Figure 20D:
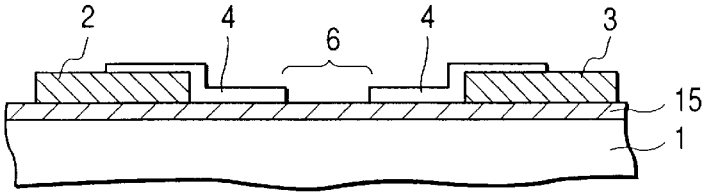

4) Successively the electron-emitting device is subjected to a conduction treatment which is referred to as a forming treatment. As a concrete technique for the forming treatment, a second gap 6 is formed in portions of the electrically conductive thin films 4 by applying a voltage across the device electrodes 2 and 3 to flowing a current to the electrically conductive thin films 4 (FIG. 20D). Though the current is supplied to form the second gap (as a forming method) in the embodiment, this method is not limitative and any method may be adopted so far as it is capable of forming a gap between the electrically conductive thin films.

Figure 6:
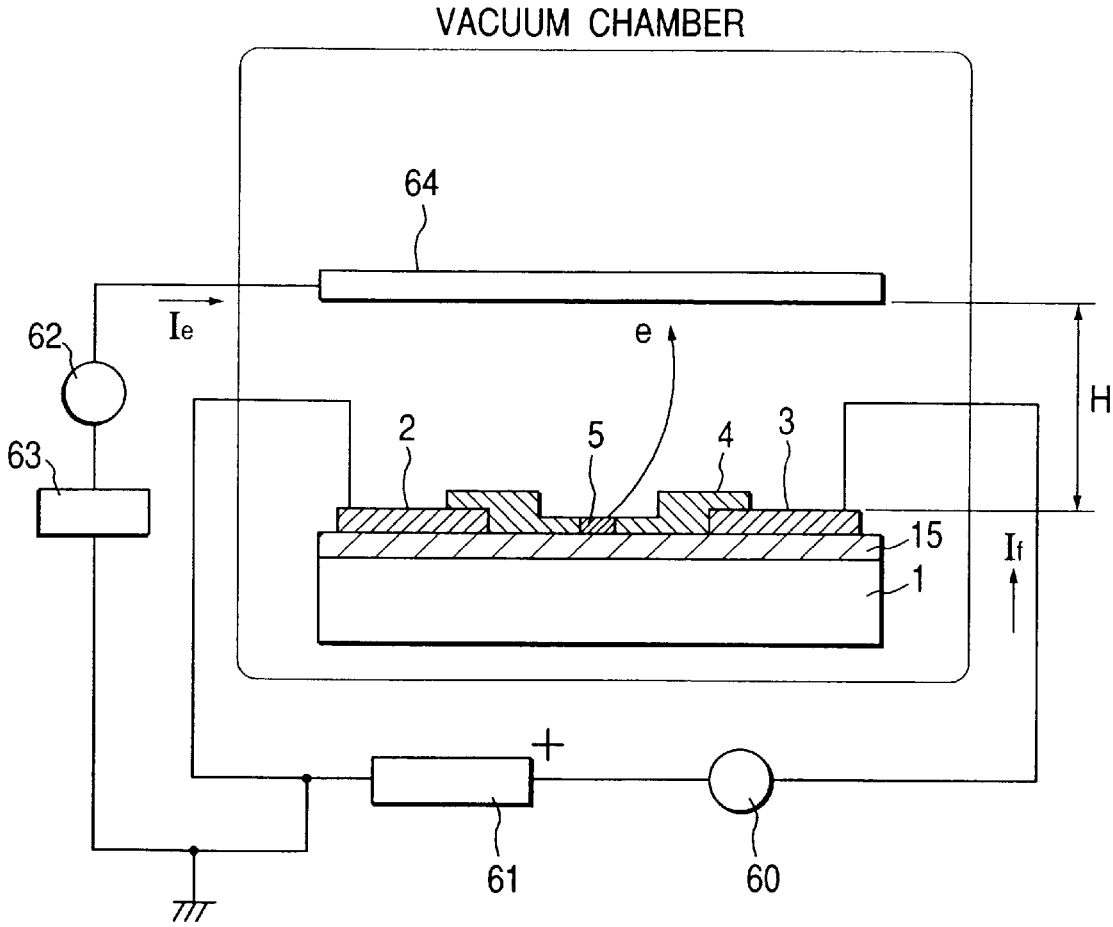
FIG. 6 is a configurational diagram showing a measurement-evaluation apparatus which is used to evaluate a characteristic of the surface conduction type electron-emitting device according to the present invention.

Other electrical treatments successive to the forming treatment can be carried out in a measurement-evaluation apparatus shown in FIG. 6. The measurement-evaluation apparatus will be described below.

FIG. 6 is a schematic diagram showing a configuration of the measurement-evaluation apparatus which measures an electron emission characteristic of the device having the configuration shown in FIGS. 1A, 1B, 19A and 19B. In FIG. 6, a reference numeral 1 denotes a substrate. Reference numerals 2 and 3 denote device electrodes, a reference numeral 4 denotes an electrically conductive thin film, a reference numeral 5 denotes an electron-emitting region and a reference numeral 15 denotes an oxynitride glass layer. Furthermore, a reference numeral 61 denotes a power source which applies a device voltage Vf to the device, a reference numeral 60 denotes an ammeter which measures a device current If supplied between the device electrodes 2 and 3, a reference numeral 64 denotes an anode which captures an emission current Ie emitted from the electrode emission member of the device, a reference numeral 63 denotes a high voltage power source which applies a voltage to the anode 64 and a reference numeral 62 denotes an ammeter which measures the emission current Ie emitted from the electron-emitting region 5 of the device.

To measure the device current If and the emission current Ie mentioned above of the electron-emitting device, the power source 61 and the ammeter 60 are connected to the device electrodes 2 and 3, and the anode 64 to which the power source 63 and the ammeter 62 are connected is disposed over the electron-emitting device. Furthermore, the electron-emitting device and the anode 64 are disposed in a vacuum chamber which is equipped with required appliances such as an evacuating pump and a vacuum gauge (not shown) so that the vacuum chamber can measure and evaluate the device under a desired vacuum. The evacuating pump consists of an ordinary high vacuum system composed of a turbo pump and a rotary pump or a high vacuum system composed of a magnetic floating turbo pump and a dry pump which do not use oil and an ultra-high vacuum system composed of an ion pump. Furthermore, the vacuum chamber as a whole and the electron-emitting device can be heated with a heater which is not shown.

The currents were measured while applying a voltage of 1 kV to 10 kV to the anode and reserving a distance H of 2 mm to 8 mm between the anode and the electron-emitting device.

Figure 7A:
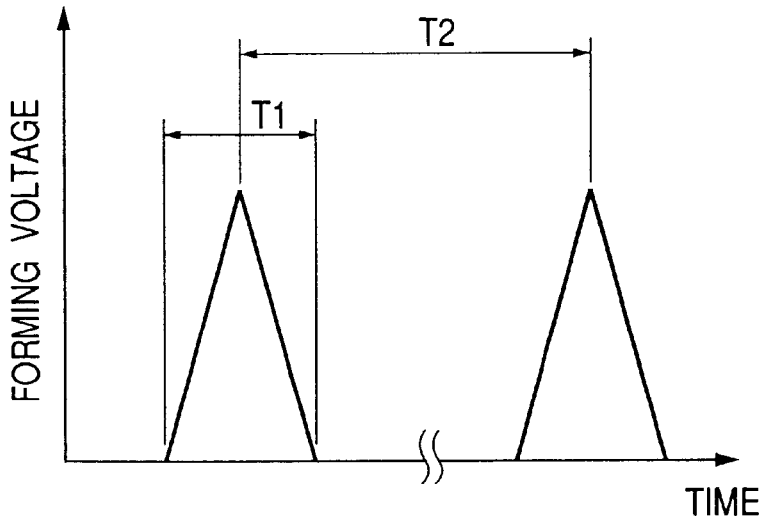
FIGS. 7A and 7B are diagrams exemplifying voltage waveforms for a forming treatment according to the present invention.

The forming treatment is carried out by applying pulses having a constant voltage crest value or voltage pulses while increasing a crest value. FIG. 7A shows a voltage waveform of the pulses having the constant crest value.

In FIG. 7A, reference symbols T1 and T2 denote a pulse width and a pulse interval of the voltage waveform, which are set at 1 $\mu$sec to 10 msec and at 10 $\mu$sec to 100 msec respectively, whereas a crest value of triangular waves (peak voltage for forming treatment) is selected adequately.

Figure 7B:
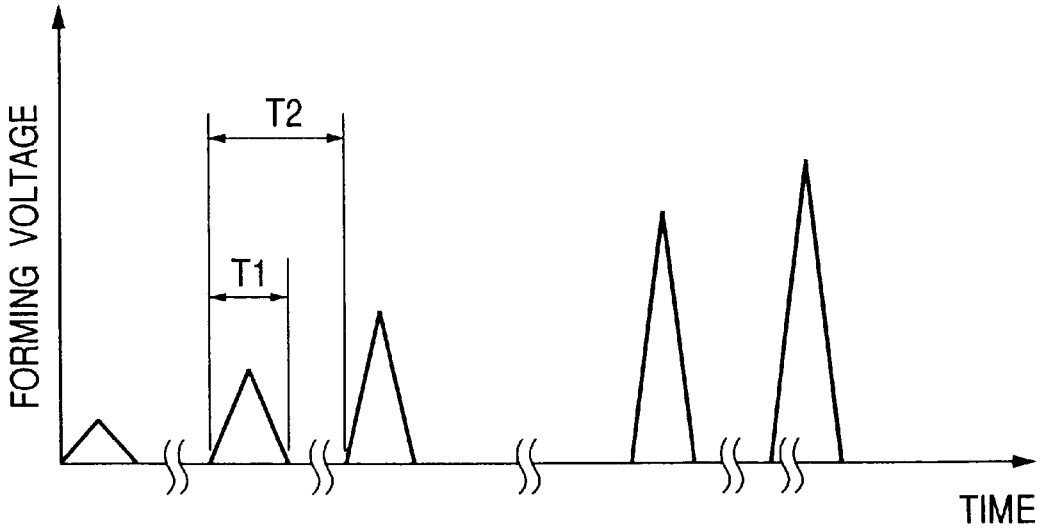

FIG. 7B shows a voltage waveform of the voltage pulses which are applied while increasing the crest value.

In FIG. 7B, reference symbols T1 and T2 denote a pulse width and a pulse interval of the voltage waveform, which are set at 1 μsec to 10 msec and 10 μsec to 100 msec respectively, whereas a crest value of triangular waves (peak voltage for forming treatment) is increased at steps, for example, of 0.1 V.

Resistance values were determined by measuring the device current with a pulse voltage, for example, on the order of 0.1 V which does not locally break or deform the electrically conductive thin film 2 between the forming pulses and the forming treatment was terminated, for example, when the electron-emitting device exhibited resistance of 1 MΩ or higher.

Though the forming treatment is carried out to form the electron-emitting region described above by applying the triangular pulses across the electrodes of the device, a waveform of the voltage pulses to be applied across the electrodes of the device is not limited to the triangular waveform but may be an optional waveform such as a rectangular waveform, and a crest value, a pulse width, a pulse interval and the like are neither limited to the values mentioned above, but may be adequately selected in accordance with a resistance value and the like of the electron-emitting device so that the electron-emitting region may be formed favorably.

When a pair of electrodes (2 and 3) are formed at an electrode interval L of several nanometers by the FIB method or the like as described above, it is possible to proceed to a subsequent step (5) with the steps (3) and (4) omitted.

5) Then, the activation treatment is effected on the device in which the second gap has been formed. The activation treatment is carried out in an atmosphere containing an organic substance. This atmosphere can be obtained by introducing an adequate organic substance into vacuum which is sufficiently evacuated once with an ion pump or the like. A pressure of the organic substance is set adequately since a preferable pressure of the organic substance is different dependently on the manner of application, a form of a vacuum vessel, a kind of the organic substance and so on.

As adequate organic substances, there can be mentioned aliphatic hydrocarbons of alkane, alkene and alkyne, aromatic hydrocarbons, alcohols, aldehydes, ketones, amines, nitrites, phenol, carbon and organic acids such as sulfonic acid, and speaking concretely, saturated hydrocarbons such as methane, ethane and propane expressed by $C_nH_{2n+2}$, unsaturated hydrocarbons such as ethylene and propylene expressed by constitutional formula of $C_nH_{2n}$, benzene, toluene, methanol, ethanol, formaldehyde, acetaldehyde, methyl ethyl ketone, methylamine, ethylamine, phenol, benzonitrile, acetonitrile, formic acid, acetic acid, propionic acid and so on are usable.

By the activation treatment, the carbon films 10 are formed on the substrate (1, 15) in the second gap and the electrically conductive thin films 4 from the organic substance existing in the atmosphere. As a result, the first gap 7 which is narrower than the second gaps is formed to remarkably increase the device current If and the emission current Ie.

Termination of the activation treatment process is adequately judged while measuring the device current If and/or the emission current Ie. The pulse width, pulse interval, pulse crest value or the like can be set adequately.

Though the graphite like carbon usable for the electron-emitting device according to the present invention includes carbon which has a complete crystalline structure of graphite (so-called HOPG), carbon having a slightly disturbed crystalline structure which has crystal grains on the order of 20 nm (PG) and carbon having largely disturbed crystalline structure having crystal grains on the order of 2 nm, it is preferable to use a material which contains carbon having a gap between graphite layers not exceeding 0.35 nm (0.335 nm in complete graphite). In other words, graphite like carbon having a structure in which layers such as grain boundaries between graphite grains are disturbed is preferably usable.

In addition, it is preferable that the film of the graphite like carbon has a thickness within a range not exceeding 50 nm and it is more preferable that the film has a thickness within a range not exceeding 30 nm.

6) It is preferable to conduct a stabilization treatment process on the electron-emitting device which is manufactured as described above. This is a process to evacuate the organic substance out of the vacuum chamber. The vacuum chamber is evacuated preferably to a pressure not exceeding $1.3\times10^{-5}$ Torr or more preferably to a pressure not exceeding $1.3\times10^{-6}$ Torr in particular. In order that a characteristic of the device is not influenced by oil emitted from an evacuation system, it is preferable to adopts an evacuation system which does not use oil to evacuate the vacuum chamber. Concretely speaking, it is preferable to adopt an evacuation system which uses adsorption pump or an ion pump. Furthermore, it is preferable for evacuating the vacuum chamber to heat the vacuum chamber as a whole so as to facilitate to evacuate the organic substance adsorbed into the inside walls of the vacuum chamber and the electron-emitting device. Though it is desirable to heat the vacuum chamber at 80 to 350° C., preferably a temperature not lower than 200° C. for a time as long as possible, these conditions are not limitative and heating conditions are adequately selected dependently on a size and form of the vacuum chamber, a configuration of the electron-emitting device and so on.

Though it is preferable to maintain the atmosphere at an end time of the stabilization treatment process as to the atmosphere during the driving after conducting the stabilization treatment till driving of the electron-emitting device, this atmosphere is not limitative and the electron-emitting device can maintain a stable characteristic even at a pressure more or less enhanced so far as the organic substance is sufficiently removed.

An atmosphere such as that described above is capable of suppressing deposition of new carbon or carbon compound, thereby stabilizing the device current If and the emission current Ie.

Figure 8:
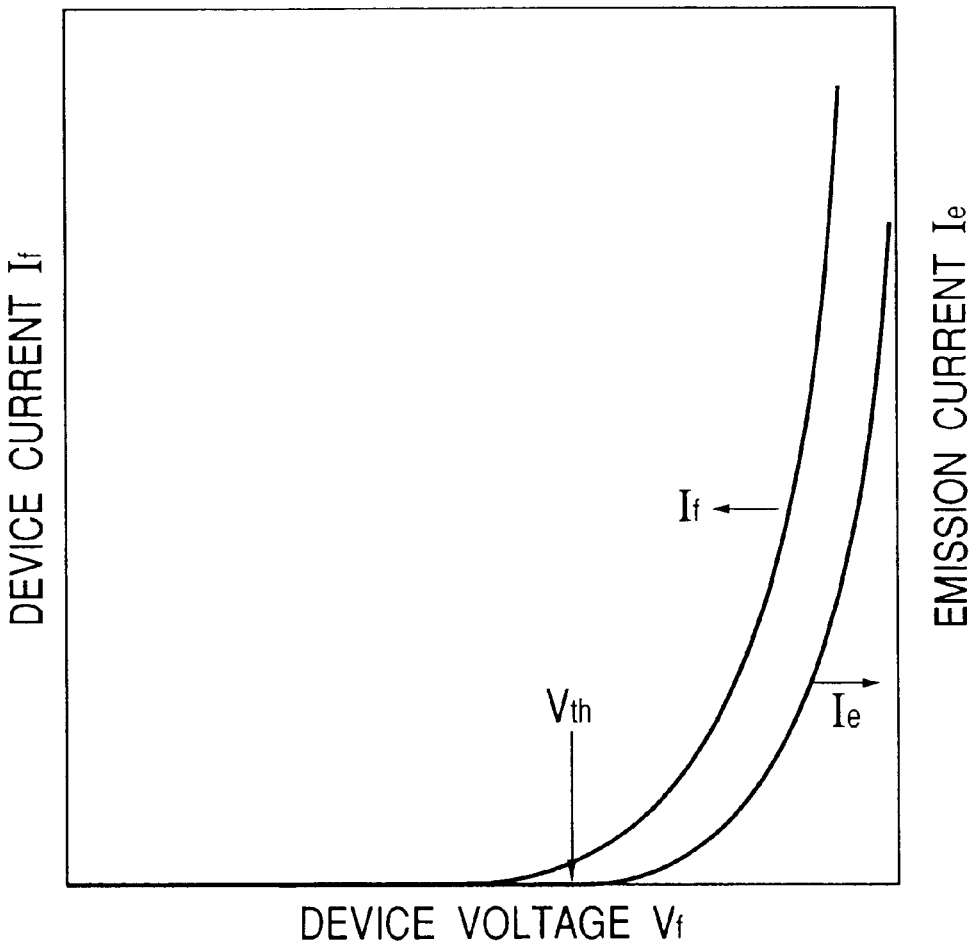
FIG. 8 is a diagram showing typical examples of relationship among an emission current, a device current and a device voltage of the surface conduction type electron-emitting device according to the present invention.

Referring to FIGS. 6 and 8, description will be made of a basic characteristic of the electron-emitting device according to the present invention which is manufactured by the manufacturing method described above.

FIG. 8 is a schematic diagram showing a typical example of relationship among the device current Ie, the device current If and the device voltage Vf which are measured by the measurement-evaluation apparatus shown in FIG. 6. The emission current Ie is shown in an optional unit in FIG. 8 since this current is remarkably lower than the device current If. An ordinate and an abscissa are scaled linearly. As apparent from FIG. 8, the surface conduction type electron-emitting device to which the present invention is applicable has three characteristic properties with regard to the emission current Ie.

First, the emission current Ie abruptly increases when a device voltage not lower than a certain voltage (Vth in FIG.

8 referred to as a threshold value voltage) is applied to the electron-emitting device, whereas the current Ie is scarcely detected when the voltage is not higher than the threshold value voltage Vth. In other words, the electron-emitting device is a non-linear device which has a clear threshold value voltage Vth relative to the emission current Ie.

Secondly, the emission current Ie can be controlled with the device voltage Vf since the emission current Ie monotonously increases as the device voltage Vf increased.

Thirdly, an amount of emitted electrons which are captured by an anode 44 is dependent on an application time of the device voltage Vf. In other words, the amount of electrons captured by the anode 44 can be controlled by the application time of the device voltage Vf.

In FIG. 8, a solid line indicates an example wherein the device current If monotonously increases with the device voltage Vf (hereinafter referred to as an "MI" characteristic). The device current If may exhibit a voltage control type negative resistance characteristic (hereinafter referred to as VCNR" characteristic) (not shown). These characteristics are controllable by controlling the steps described above.

It is possible to easily control an electron emission characteristic in correspondence to an input signal using the characteristics of the surface conduction type electron-emitting device described above. Furthermore, it is expected that the electron-emitting device according to the present invention which has the high luminance characteristic which is stable for a long time is applied to a variety of fields.

Description will be made below of application examples of the electron-emitting device according to the present invention.

The present invention makes it possible to compose, for example, an electron source or an image forming apparatus by arranging a plurality of electron-emitting devices on a substrate.

As arrangement modes of the devices on a substrate, there can be mentioned, for example, a mode (referred to as a ladder type) wherein there are formed a large number of rows of electron-emitting devices on each of which a large number of the electron-emitting devices are arranged in parallel (referred to as a row direction) and both ends of each electron-emitting device are connected to wires so that electrons are controlled and driven with a control electrode (referred to as a grid) disposed in a space over an electron source in the direction othogonal to these wires (referred to as a line direction), and another mode in which n wires are arranged in a Y direction on m wires in an X direction with an insulating layer interposed, and the wires in the X and Y directions are connected to a pair of device electrodes of the surface conduction type electron-emitting devices. This arrangement will hereinafter referred to as a simple matrix arrangement.

The simple matrix arrangement will be described in detail below:

The three basic characteristic properties of the surface conduction type electron-emitting device according to the present invention described above permit controlling electrons emitted from the surface conduction type electron-emitting device with a crest value and a width of a pulse like voltage to be applied across the device electrodes which are opposed to each other when the device voltage is not lower than the threshold valve voltage. When the device voltage is not higher than the threshold value voltage, on the other hand, electrons are scarcely emitted. Even when the large number of electron-emitting devices are arranged, this characteristic makes it possible to control an amount of electrons to be emitted in correspondence to an input signal by adequately applying the pulse like voltage to the individual electron-emitting devices so as to select the surface conduction type election emission elements.

Figure 9:
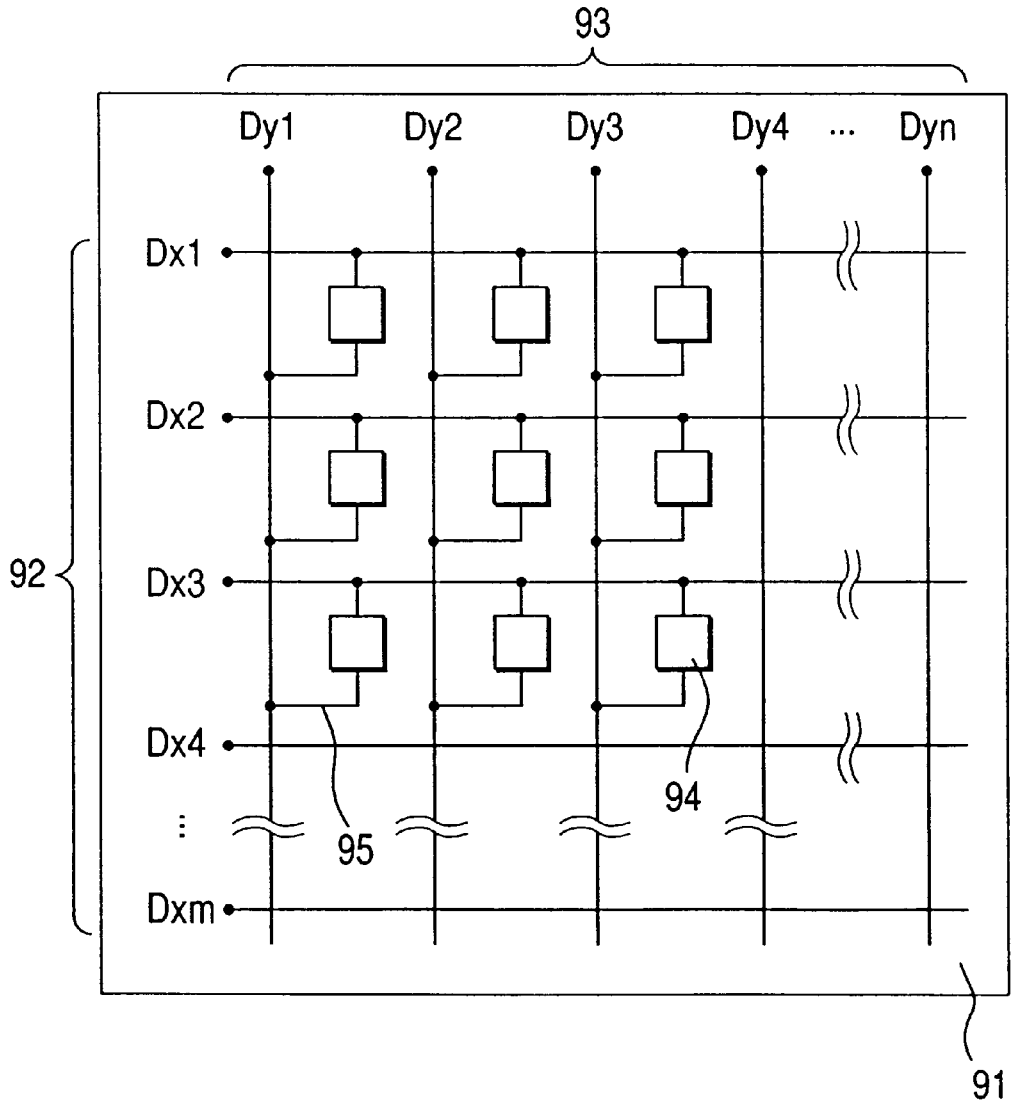
FIG. 9 is a diagram showing a configuration of an electron source substrate according to the present invention.

Description will be made below of an electron source substrate which is configured on this principle with reference to FIG. 9. m wires 92 formed in the X direction comprise DX1, DX2, . . . DXm and are configured on the substrate 1 by the vacuum deposition method, printing method, sputtering method or the like and are made of an electrically conductive metal or the like while selecting a material, a thickness and a width so that nearly equal voltages are supplied to the large number of surface conduction type electron-emitting devices. n wires 93 DY1, DY2, . . . DYn are formed in the Y direction like the wires in the X direction. Arranged between the m wires 92 in the X direction and the n wires 93 in the Y direction are insulating layers (not shown) to separate these wires and compose a matrix wiring (both m and n are positive integers).

The insulating layers are formed with $SiO_2$ or the like by the vacuum deposition method, printing method, sputtering method or the like. The insulating layers are formed in a desired shape, for example, on a partial area or entire area of a substrate 71 on which the wires 92 are formed in the X direction, and have a thickness, a material and a forming method of the insulating layers are adequately selected so that the layers are bearable of a potential difference at intersections between the wires 92 in the X direction and the wires 93 in the Y direction in particular. The wires 92 in the X direction and the wires 93 in the Y direction are pulled out as external terminals.

Furthermore, a pair of electrode (not shown) which compose the surface conduction type electron-emitting device 94 are electrically connected by the m wires 92 in the X direction (DX1, DX2, . . . DXm), the n wires in the Y direction (DY1, DY2, . . . DYm) and wires 95 made of an electrically conductive metal or the like.

The m wires 92 in the X direction, the n wires 93 in the Y direction and the pair of device electrodes may be made of the same material composed of the same element or materials composed of partially or entirely different elements. The materials are selected adequately, for example, from among the materials for the device electrode which are mentioned above.

Though detailed description will be made later, the wires 92 in the X direction are electrically connected to scanning signal application means (not shown) which scans the lines of the surface conduction type electron-emitting devices 94 arranged in the X direction in correspondence to an input signal. On the other hand, the wires 93 in the Y direction are electrically connected to modulation signal generator means (not shown) which modulates each row of the surface conduction type electron-emitting devices 94 arranged in the Y direction in correspondence to an input signal.

Furthermore, a driving voltage which is applied to each surface conduction type device is supplied as a differential voltage between a scanning signal applied to the element and the modulation signal.

Figure 10:
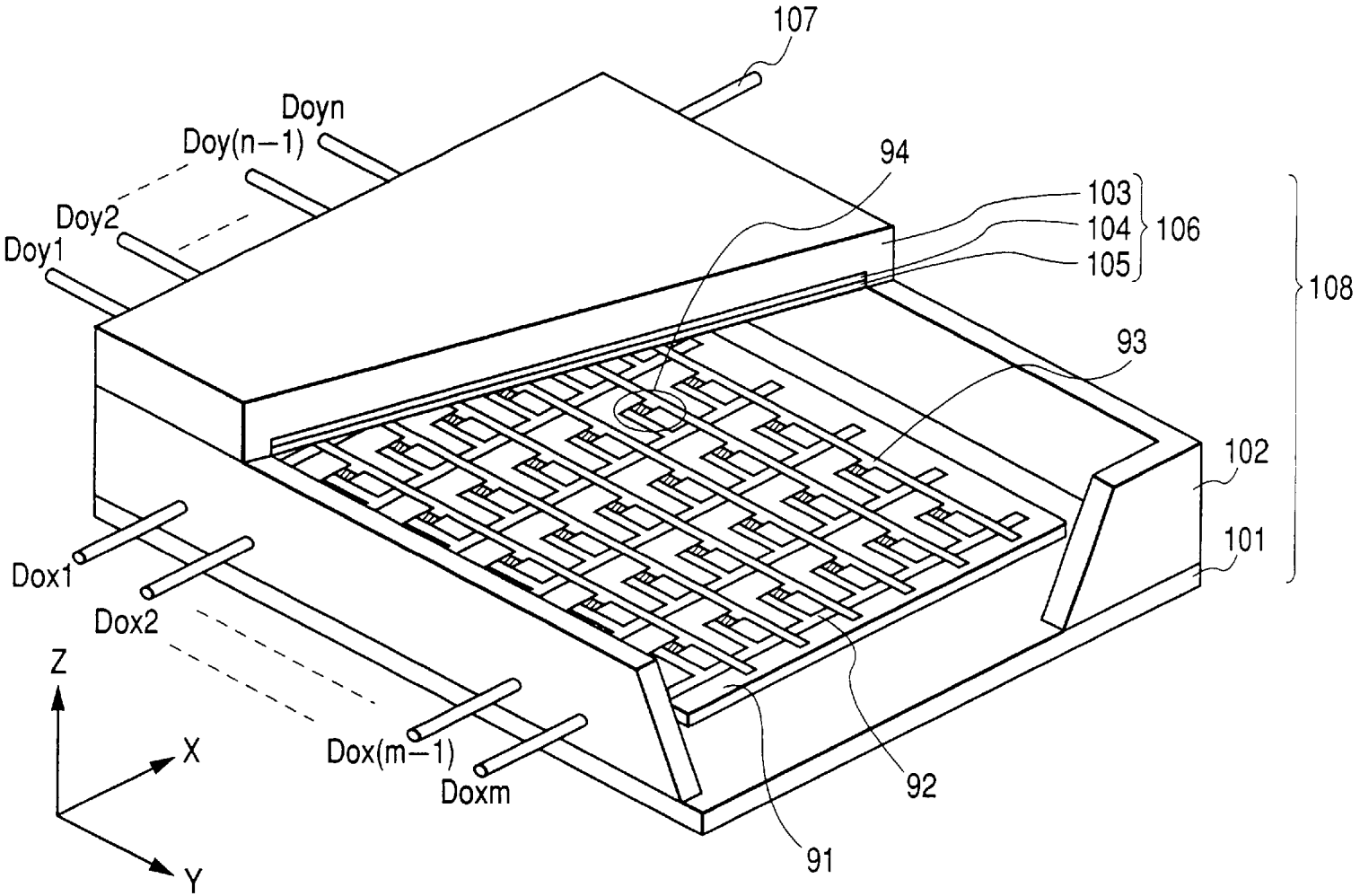
FIG. 10 is a diagram showing a basic configuration of the image forming apparatus according to the present invention.
Figure 11A:
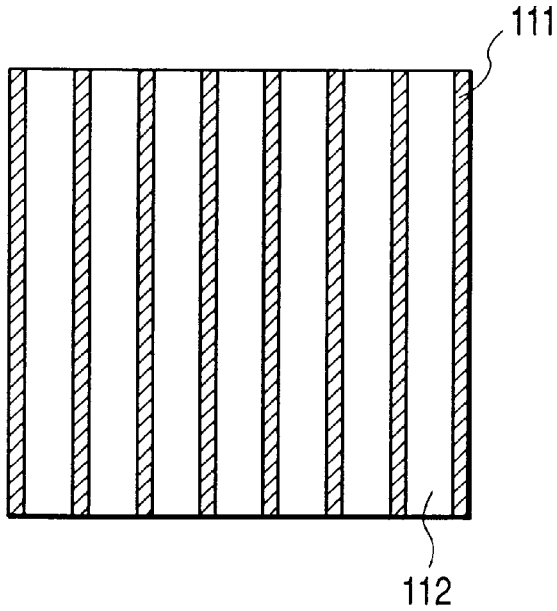
FIGS. 11A and 11B are diagrams showing a fluorescent film to be used in the image forming apparatus in FIG. 8.
Figure 11B:
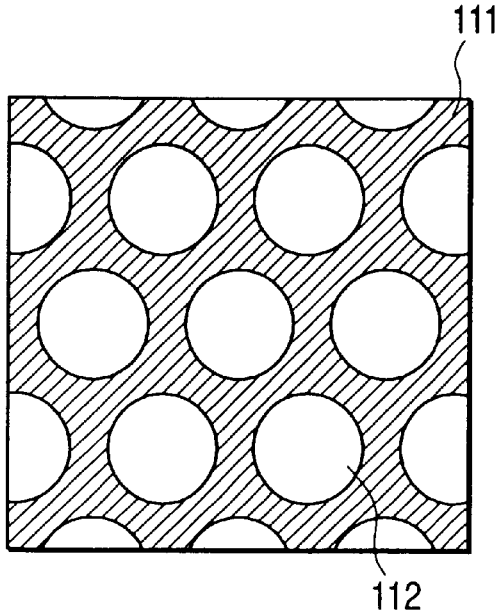

Now, description will be made of an electron source which uses the electron source substrate manufactured as described above and an image forming apparatus which is used for display with reference to FIGS. 10, 11A and 11B. FIG. 10 is a diagram showing a basic configuration of the image forming apparatus, whereas FIGS. 11A and 11B are diagrams showing a fluorescent film.

In FIG. 10, a reference numeral 91 denotes an electron source substrate on which a plurality of electron-emitting devices are disposed, a reference numeral 101 denotes a rear plate to which the electron source substrate 91 is fixed, a reference numeral 106 denotes a face plate on which a fluorescent film 104, a metal back 105 and so on are formed so as to be located on an inside surface of a glass substrate 103. A reference numeral 102 denotes a support frame to which the rear plate 101 and the face plate 106 are sealed by coating frit glass or the like and baking the plates in atmosphere or nitrogen for 10 minutes or longer at a temperature of 400 to 500° C., there by composing an enclosure 108.

In FIG. 10, a reference numeral 94 denotes a member which corresponds to the surface conduction type electron-emitting region shown in FIGS. 1A and 1B, and in FIGS. 2A and 2B. Reference numerals 92 and 93 denotes wires on the X direction and the Y direction which are connected to a pair of device electrodes of a surface conduction type electron-emitting device. Wires to these device electrodes may be referred to as device electrodes when the wires are made of a material which is the same as that of the device electrodes.

Though the enclosure 108 is composed of the face plate 106, the support frame 102 and the rear plate 101 as described above, the rear plate 101 is used mainly to reinforce the substrate 91 and it is unnecessary to dispose the rear plate 101 separately when the substrate 91 proper has sufficient strength. In other words, it is possible to seal the support frame 102 directly to the substrate 91, and compose the enclosure 108 of the face plate 106, the support frame 102 and the substrate 91. On the other hand, it is possible to compose the enclosure 108 so that it has sufficient strength to an atmospheric pressure by disposing a support member called a spacer (not shown).

FIGS. 11A and 11B are schematic diagrams showing a fluorescent film. A fluorescent film 104 is composed of only a fluorescent substance when it is a monochromatic fluorescent film, but of a black electrically conductive material 111 called black stripe or black matrix and fluorescent substances 112 in case of a color fluorescent film. The black stripe or black matrix is used to make color mixing less noticeable by blackening borders among the fluorescent substances 112 of the three primary colors for color display and prevent contrast from being lowered due to reflection of external light at the fluorescent film 104. Usable as the black stripe is not only a material having a main component of graphite conventionally used but also a material which has electric conductivity, low light transmittance and low light reflectance.

To coat the fluorescent substance to the glass substrate, a precipitation method, a printing method or the like may be adopted for both the monochromatic fluorescent film and the color fluorescent film. The metal back 105 is usually disposed on an inside surface of the fluorescent film 104. The metal back is disposed to enhance luminance by totally reflecting inside rays out of those emitted from the fluorescent substance toward the face plate 106, to function the fluorescent substance as an electrode to apply an electron beam accelerating voltage and to protect the fluorescent substance from damage due to collision with negative ions produced in the enclosure. The metal back can be manufactured by performing a smoothing treatment of the inside surface of the fluorescent film after it is formed and then depositing A by vacuum evaporation.

At the face e plate 106 a transparent electrode (not shown) may further be formed on an outside surface of the fluorescent film 104 to enhance electric conductivity of the fluorescent film 104. When the fluorescent film 104 is the color film, it is necessary to correspond each fluorescent substances to each electron-emitting device and the members must be sufficiently positioned at a stage of the sealing described above.

The enclosure 108 is sealed after it is evacuated to a vacuum degree on the order of $1.3\times10^{-5}$ Pa through an exhaust pipe (not shown). Furthermore, a getter t treatment may be carried out to maintain a vacuum degree after sealing the enclosure 108. This is a treatment to form a deposit film by heating a getter disposed at a predetermined location (not shown) in the enclosure 108 with an electric resistance heater or a high-frequency heater immediately before or after sealing the enclosure 108. The getter usually has a main component of Ba or the like and is maintained at a vacuum degree, for example, of $1.3\times10^{-3}$ Pa to $1.3\times10^{-5}$ Pa by an adsorbing function of the deposit film.

The image forming apparatus according to the present invention which is completed as described above displays an image when a voltage is applied to the electron-emitting devices by way of the terminals Dox1 through Doxm and Doy1 through Doyn outside the vacuum chamber to emit electrons and a high voltage not lower than several kilovolts to the metal back 105 or the transparent electrode (not shown) by way of the high voltage terminal 107 to accelerate an electron beam so that it impinges, excites and glows the fluorescent film 104.

The configuration described above is a rough configuration required to manufacture an image forming apparatus preferable for display, etc., and minor portions such as materials for the members are not limited by the description made above and may be selected adequately so as to be matched with a purpose of application of the image forming apparatus.

Figure 12:
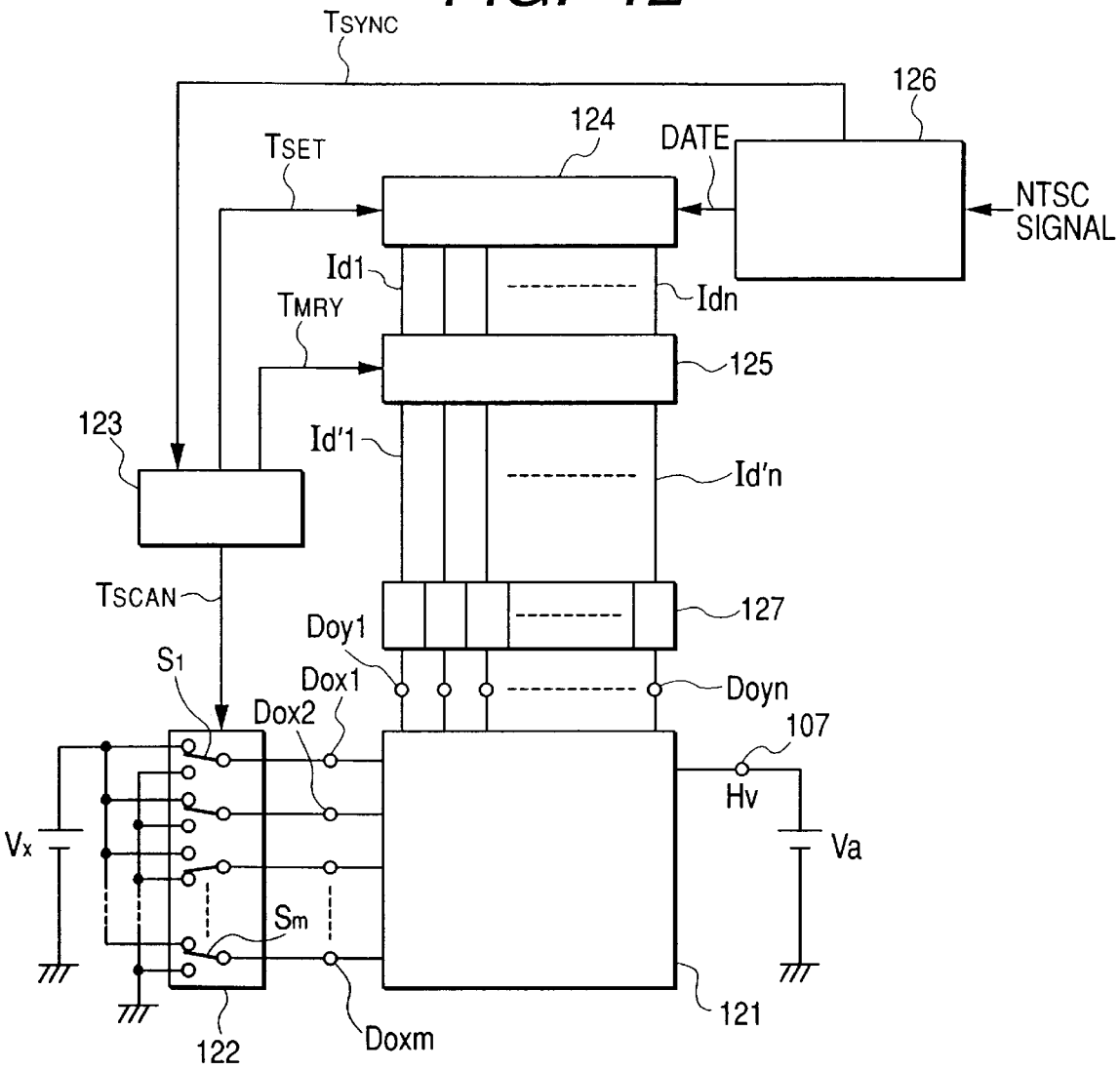
FIG. 12 is a block diagram of a driving circuit in an example wherein the image forming apparatus according to the present invention is used to display images in corresponding to TV signals in an NTSC mode.

Referring to FIG. 12, description will be made of a configurational example of driving circuit for displaying a TV image on a display panel which is composed using the electron source having the simple matrix arrangement on the basis of TV signals in the NTSC mode.

A block diagram exemplifying the driving circuit which is used to display an image in accordance with the TV signals in the NTSC mode is shown in FIG. 12, wherein a reference numeral 121 denotes an image display panel, a reference numeral 122 denotes a scanning signal generator circuit, a reference numeral 123 denotes a timing control circuit and a reference numeral 124 denotes a shift register. A reference numeral 125 denotes a line memory, a reference numeral 126 denotes a synchronous signal separator circuit, a reference numeral 127 denotes a modulation signal generator, and reference symbols Vx and Va denote DC voltage sources.

The display panel 121 is connected to an external electric circuit by way of the terminals Dox1 through Doxm, terminals Doy1 through Doyn and high voltage terminal (Hv) 107. Applied to the terminals Dox1 through Doxm are scanning signals to sequentially drive, line by line (n elements by n elements), the electron sources disposed in the display panel, that is, the surface conduction type electron-emitting devices which are arranged in a matrix of m lines by n rows. Applied to the terminals Dy1 through Dyn are modulation signals to control electron beams output from the each device of surface conduction type electron-emitting devices on a line selected by the scanning signals. Applied from the DC voltage source Va to the high voltage terminal 107 is a DC voltage, for example, of 10 kV which is an accelerating voltage to impart an energy sufficient for excitation of the fluorescence substance to the electron beam emitted from the surface conduction type electron-emitting devices.

The scanning signal generator circuit 122 comprises m switching devices (schematically represented by reference symbols S1 through Sm in FIG. 12). The switching devices select either an output voltage from the DC voltage source Vx or O [V] (ground level) and are electrically connected to the terminals Dx1 through DYm on the display panel 121. The switching devices S1 through Sm operate on the basis of a control signal Tscan output from the control circuit 123 and can be composed by combining, for example, FETs.

In this embodiment, the DC voltage source Vx is configured by outputting a voltage at a constant level at which a driving voltage not higher than the electron emission threshold value is applied to a device which is not scanned on the basis of the characteristic of the surface conduction type electron-emitting device (electron emission threshold value voltage).

The timing control circuit 123 has a function to match operations of the component members so that an image is displayed adequately on the basis of video signals which are input from outside. On the basis of the synchronous signal Tsync sent from the synchronous signal separator circuit 126, the timing control circuit 123 generates controls signals Tscan, Tsft and Tmry to the component members.

The synchronous signal separator circuit 126 is a circuit which separates a synchronous signal component and a luminance signal component from the TV signal in the NTSC mode which are input from outside, and can be composed of a general frequency separator (filter) circuit or the like. Though the synchronous signal which is separated by the synchronous signal separator circuit consists of a vertical synchronous signal and a horizontal synchronous signal, it is represented as the Tsync signal for convenience of description. The luminance signal component which is separated from the TV signal is designated as a DATA signal for convenience of description. The DATA signal is input into the shift register 124.

The shift register 124 performs serial/parallel conversion per line of the DATA signal which is input in a time series and operates on the basis of the control signal Tsft sent from the control circuit 123 (that is, the control signal Tsft can be said as a shift clock for the shift register 124). Data corresponding to a line of an image which has been subjected to the serial/parallel conversion (corresponding to driving data for N electron-emitting devices) is output as N parallel signals Id1 through Idn from the shift register 124.

The line memory 125 is a memory to store data corresponding to a line of an image for a required time and stores contents of Id1 through Idn according to the control signal Tmry sent from the control circuit 123. Stored contents are output as I'd1 through I'dn and input into the modulation signal generator 107.

The modulation signal generator 127 is a signal source which drives and modulates the surface conduction type electron-emitting devices adequately in accordance with the image data I'd1 through I'dn, and output signal from the modulation signal generator 127 is input to the surface conduction type electron-emitting devices in the display panel 121 by way of the terminals Doy1 through Doyn.

As described above, the electron-emitting device according to the present invention has the following basic characteristic with respect to the emission current Ie. That is, the device has a clear threshold value voltage Vth and emits electrons only when a voltage of Vth or higher is applied. At a voltage of Vth or higher, the emission current also varies as a voltage applied to the device varies. Accordingly, the device does not emit electrons when a voltage lower than the threshold value is applied, but the device emits electrons when a voltage not lower than the threshold value is applied. It is possible at this stage to control an intensity of an output electron beam by varying a crest value Vm of pulses. Furthermore, it is possible to control a total amount of electric charge s of the output electron beam by varying a width Pw of the pulses. Accordingly, the driving circuit can adopt a voltage modulation system and a pulse width modulation system to modulate the electron-emitting devices in accordance with input signals.

To obtain the voltage modulation system, it is possible to use, as the modulation signal generator 127, a voltage modulation type circuit which generates voltage pulses having a definite length and modulates a crest value of the pulses in accordance with input data.

To obtain the pulse width modulation system, it is possible to use, as the modulation signal generator 127, a pulse width modulation type circuit which generates voltage pulses having a definite crest value and modulates a width of the voltage pulses in accordance with input data.

The shift register 124 and the line memory 125 may be of a digital signal type or an analog signal type. The shift register 124 and the line memory 125 are sufficient so far as these members perform the serial/parallel conversion and data storage at predetermined speeds.

When the shift register 124 is of the digital signal type, it is necessary to convert the output signal DATA from the synchronous signal separator circuit 126 into a digital signal and this conversion can be performed by disposing an A/D converter at an output section of the synchronous signal separator circuit 126. Furthermore, a circuit which is to be used in the modulation signal generator 127 is somewhat different dependently on whether the line memory 125 outputs a digital signal or an analog signal. That is, in case of the voltage modulation system which uses the digital signal, a D/A converter circuit, for example, is used in the modulation signal generator 127 and an amplifier circuit or the like is added as occasion demands. In case of the pulse width modulation system, a circuit which consists, for example, of a combination of a high-speed oscillator, a counter which counts a number of waves output from the oscillator and a comparator which compares an output value from the counter with an output value from the memory is used in the modulation signal generator 127. It is possible to add, as occasion demands, an amplifier which amplifies a voltage of a modulation signal modulated in a pulse width output from the comparator to the driving voltage for the surface conduction type electron-emitting devices.

In case of the voltage modulation system which uses the analog signal, it is possible to adopt, for example, an amplifier circuit using an operation amplifier as the modulation signal generator 127 and add a level shift circuit as occasion demands. In case of the pulse width modulation system, it is possible to adopt, for example, a voltage control type oscillator circuit (VCO) and add, as occasion demands, an amplifier which amplifies the voltage to the driving voltage for the surface conduction type electron-emitting devices.

In the image forming apparatus which can have the configuration described above, electrons are emitted when a voltage is applied to the electron-emitting devices by way of the terminals Dox1 through Doxm and Doy1 through Doyn outside the vacuum chamber. An electron beam is accelerated by applying a high voltage to the metal back 105 or the transparent electrode (not shown) by way of the high voltage terminal Hv (107). The electron beam which is accelerated impinges and glows the fluorescent film 104, thereby forming an image.

The configuration of the image forming apparatus is an example of the image forming apparatus according to the present invention which is variously modifiable on the basis of a basic concept of a technical concept of the present invention. Though the input signals in the NTSC mode are mentioned above, the input signals are not limited to this mode but may be in another mode such as the PAL or SECAM mode and it is possible to adopt TV signals consisting of more scanning lines (for example, in a high definition TV mode such as MUSE mode).

The image forming apparatus according to the present invention is usable not only as a display apparatus for TV broadcasting, a TV meeting system and a computer but also as an image forming apparatus which is configured as an optical printer composed using a photosensitive drum or the like.

Now, the present invention will be described in more detail with reference examples.

EXAMPLE 1

An electron-emitting device manufactured in this example has a configuration which is the same as that shown in the plan views and sectional views presented as FIGS. 1A, 1B, 19A and 19B. The electron-emitting region shown in FIGS. 1A and 1B is shown in more detail in FIGS. 19A and 19B.

The electron-emitting device in this example was manufactured basically in the procedures shown in FIGS. 5A through 5D and 20A through 20E. Description will be made below of a configuration and a manufacturing method of the device which is manufactured in Example 1 with reference to FIGS. 1A, 1B, 5A through 5D, 19A, 19B and 20A through 20E. FIGS. 20A through 20E illustrate manufacturing processes in more detail than FIGS. 5A through 5D.

The manufacturing method will be described below in a due order on the basis of FIGS. 1A, 1B, 5A through 5D, 19A, 19B and 20A through 20E.

Step-a

First, an oxynitride glass layer 15 1 $\mu$m thickness was formed a cleaned soda lime glass 1 by the sol-gel method. The oxynitride glass used in Example 1 contained Si, O, N, Y and Al. A compositional ratio among these elements was 30 atom % of Si: 62 atom % of O: 5 atom % of N: 1 atom % of Y: 2 atom % of Al. A nitrogen content was adjusted to 5 atom % by baking the substrate 1 (FIGS. 5A and 20A).

To clarify the effect of the present invention, on the other hand, an element manufactured as a comparative example by preparing a soda lime glass on which the oxynitride glass layer 15 was not formed and treating it at subsequent steps in the same manner as the device manufactured in Example 1.

Step-b

Patterns which were to be device electrodes 2, 3 and a gap L between the device electrodes were formed with photoresist (RD-2000N prepared by Hitachi Chemical Product, Co., Ltd.) on the substrate 1 on which the oxynitride glass layer 15 was formed, and a Ti film 5 nm thick and an Ni film 100 nm thick were sequentially deposited by an electron beam deposition method. The device electrodes 2 and 3 which had a width W of 300 $\mu$m were formed by dissolving the photoresist patterns with an organic solvent, lifting off the Ni/Ti deposit film setting the gap between the device electrodes set at 3 $\mu$m (FIGS. 5B and 20B).

Step-c

After depositing A Cr film 100 nm thick by vacuum deposition method and patterning it so as to form an opening corresponding to a shape of an electrically conductive film described later, a solution of an organic palladium (ccp4230 prepared by Okuno Pharmaceutical, Co., Ltd.) was coated to the Cr film with a spinner and calcined for 12 minutes by heating it at 300° C. An electrically conductive thin film 4 consisting mainly of Pd which was formed as described above had a thickness of 10 nm and a sheet resistance of $2\times10^4$ Ω/□.

Step-d

The Cr film and the calcined electrically conductive film 4 were etched with an acid etchant, thereby forming an electrically conductive film 4 which had a desired pattern (FIGS. 5C and 20C).

By the steps described above, the oxynitride glass layer 15, the device electrodes 2, 3 and the electrically conductive thin film 4 were formed on the substrate 1.

Step-e

Then, the substrate 1 was placed in the measurement-evaluation apparatus shown in FIG. 6, the forming treatment was carried out by evacuting the vacuum chamber with a vacuum pump to a vacuum degree of $1.3\times10^{-6}$ Pa and applying a voltage across the device electrodes 2 and 3 from the power source 61 which was provided to apply the device voltage Vf to the device. The voltage for the forming treatment had a waveform shown in FIG. 7B. The second gap 6 was formed by this step (FIG. 20D).

For the forming treatment, T1 and T2 which are the pulse width and the pulse interval of the voltage waveform shown in FIG. 7B were set at 1 msec and 10 msec respectively, and increasing a crest value of a rectangular wave at 0.1 V steps, and the forming treatment was carried out. During the forming treatment, resistance was measured by inserting a resistance measuring pulse between the forming pulses at a voltage of 0.1 V. The forming treatment was terminated together with the voltage application to the element when a value measured with the resistance measuring pulse exceeded approximately 1 MΩ.

Step-f

Figure 5D:
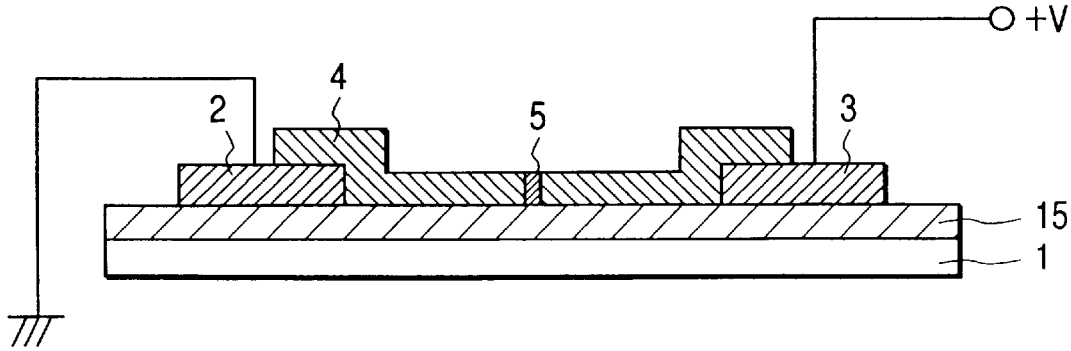
Figure 13:
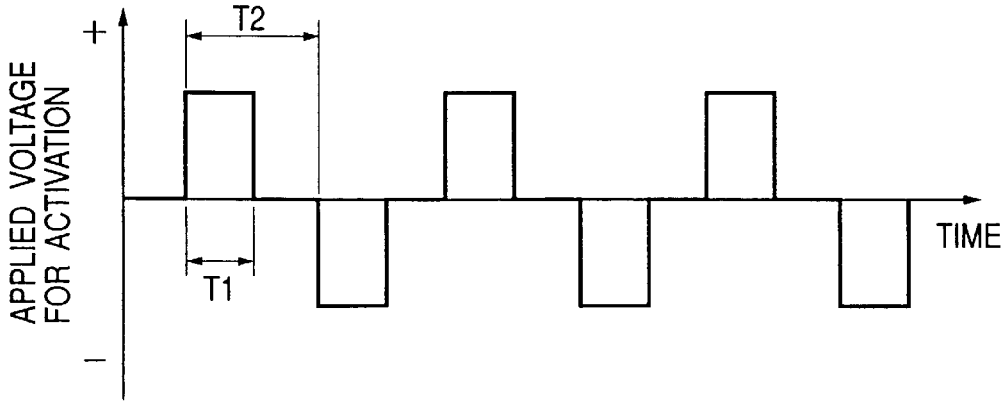
FIG. 13 is a diagram showing activation pulses preferable for the present invention.
Figure 20E:
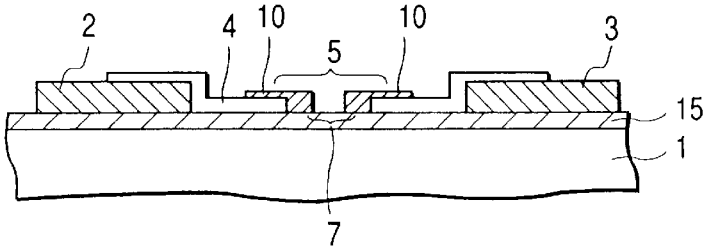

Successively, tolunitrile was introduced into the vacuum chamber through a slow leak valve to carry out the activation step and maintained at $1.3\times10^{-4}$ Pa. With a crest value set at 14 V for the waveform shown in FIG. 13, the activation treatment was then conducted on the device which was subjected to the forming treatment. In other words, a pulse voltage was applied across the device electrodes while measuring the device current If in the measurement-evaluation apparatus. Since an If value was saturated in about 15 minutes, the voltage application was stopped and the allow leak valve was closed to terminate the activation treatment. The carbon film 10 and the first gaps 7 were formed at the same time by this step (FIGS. 20E and 5D).

Step-g

A stabilization step was carried out successively. The vacuum chamber was evacuated continuously while heating and maintaining the vacuum chamber and the electron-emitting device at approximately 250° C. with a heater. An internal pressure of the vacuum chamber reached approximately $6.7\times10^{-8}$ Pa when the heating with the heater was stopped 20 hours later and the vacuum chamber was cooled to rom temperature.

An electron emission characteristic was measured successively.

With a distance H between the anode 64 and the electron-emitting device set at 4 mm, the anode 64 was set at a potential of 1 kV using the high voltage power source 63. In this condition, a rectangular pulse voltage having a crest value of 14 V was applied across the device electrodes 2 and 3, and the device current If and the emission current Ie of the device in Example 1 and the element in the comparative example were measured respectively with the ammeter 60 and the ammeter 62.

The device in Example 1 indicated the device current If=5.0 mA, the emission current Ie=10.5 $\mu$A and an electron emission efficiency $\eta$ (=Ie/If)=0.21%. The device in the comparative example exhibited the device current If=2.0 mA, the emission current Ie=4.0 $\mu$A and the electron emission efficiency $\eta$ (=Ie/If)=0.20%.

When the device current If and the emission current Ie were measured after allowing the devices to emit electrons for a definite time, the device in Example 1 exhibited the device current If=5.0 mA, the emission current Ie=10.5 $\mu$A and the electron emission efficiency $\eta$ (=Ie/If)=0.21% which remained unchanged, whereas the device in the comparative example exhibited the device current If=1.5 mA, the emission current Ie=3.5 $\mu$A and the electron emission efficiency $\eta$ (=Ie/If)=0.23%.

Furthermore, measurements of surfaces of the device in the Example 1 and the device in the comparative example by XPS (X-ray photoelectron spectroscopy) allowed to observe remarkable separation of Na on the device in the comparative example. It is assumed that Na dispersed from the soda lime glass to the surface of the device.

On the other hand, it is assumed that the device in Example 1 which used oxynitride glass in which a portion of oxygen is substituted for nitrogen in $SiO_2$ has a dense network structure, thereby preventing sodium ions contained in the soda lime glass from penetrating or moving into the device.

Furthermore, the oxynitride glass has a higher strain point and a smaller thermal expansion coefficient than those of the soda lime glass, whereby a temperature rise causes a less variation of a shape of the oxynitride glass.

These results indicated that the device in Example 1 not only provides the emission current Ie higher than the device in the comparative example but also exhibits a higher stability while it is driven.

EXAMPLE 2

Figure 21A:
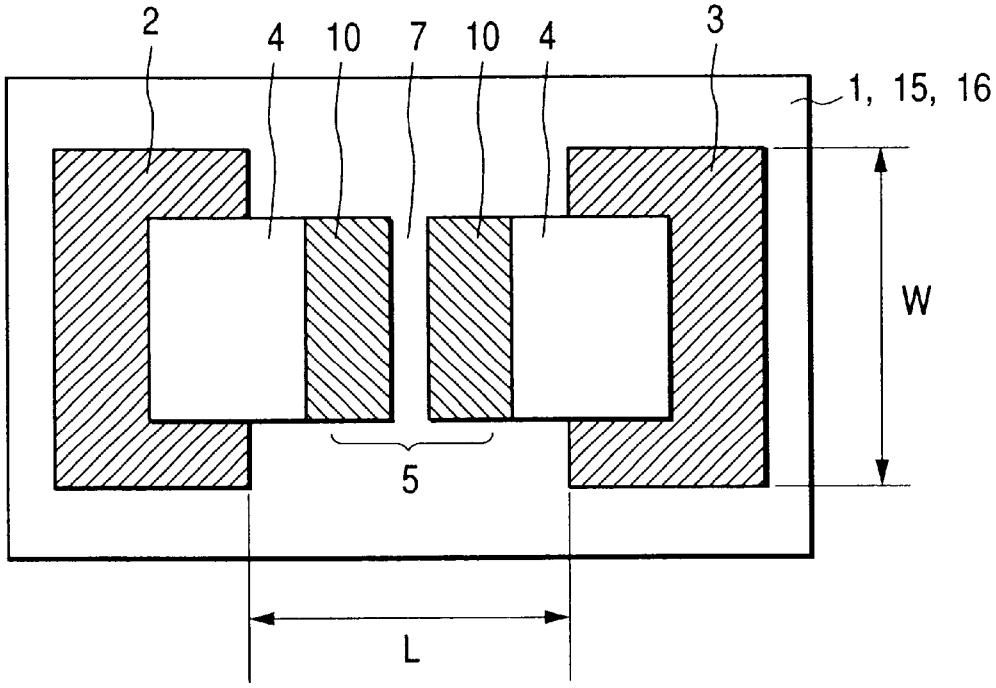
FIGS. 21A and 21B are schematic diagrams showing another configuration of the electron-emitting device according to the present invention.
Figure 21B:
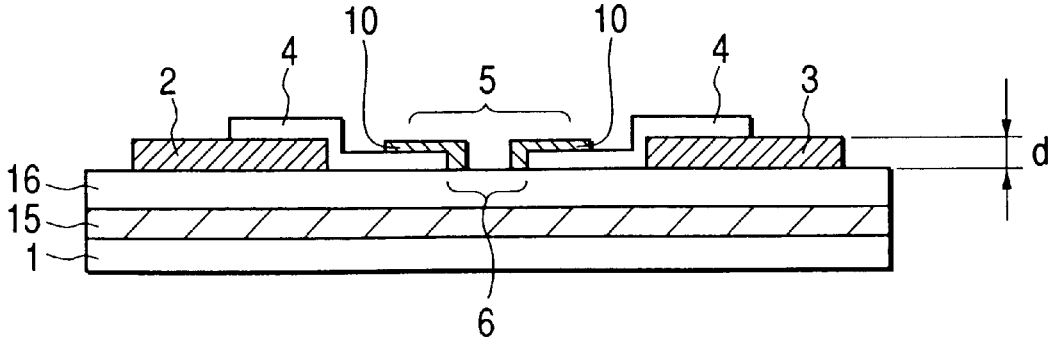

A device manufactured in Example 2 has a configuration which is the same as that shown in the plan view and sectional views presented as FIGS. 2A, 2B, 21A and 21B. Speaking concretely, formed on a substrate was a silica layer 16 in addition to the oxynitride glass layer 15 formed in Example 1. Other members were the same as those formed in Example 1. FIGS. 21A and 21B illustrate the electron-emitting region 5 in more detail than FIGS. 2A and 2B.

Furthermore, a manufacturing method of the surface conduction type electron-emitting device in Example 2 is also basically the same as that in Example 1. A basic configuration and the manufacturing method of the element in Example 2 will be described with reference to FIGS. 2A, 2B, 21A, 21B and 22A through 22E.

The manufacturing method will be described below in a due sequence on the basis of FIGS. 22A through 22E.

Step-a

Figure 22A:
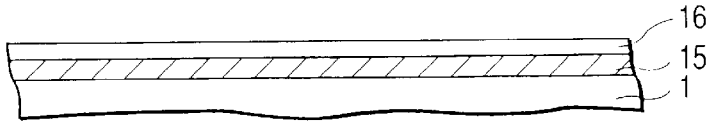
FIGS. 22A, 22B, 22C, 22D and 22E are schematic diagrams showing different processes to manufacture the electron-emitting device according to the present invention.

As in Example 1, a Y—Al—Si—O—N oxynitride glass layer 15 1 $\mu$m thickness was formed on a cleaned soda lime glass substrate 1 by the sol-gel method. A nitrogen content was adjusted to 5 atom % by baking the glass substrate 1 in an atmosphere of ammonia. Furthermore, a silica layer 40 nm thick was formed on the oxynitride glass layer 15 by an RF sputtering method (FIG. 22A).

In order to clarify the effect of the present invention, on the other hand, a device is manufactured as a comparative example by preparing a substrate on which the oxynitride glass layer 15 was not formed but the silica layer 16 was formed, and treating the substrate in the same manner as the device in Example 2 at subsequent steps.

Step-b

Figure 22B:
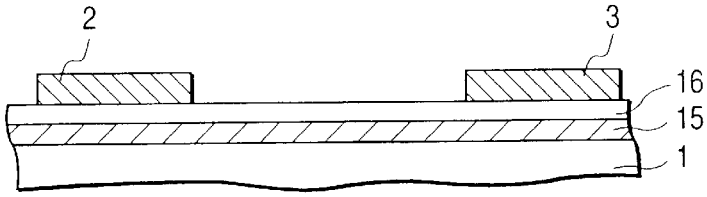

Patterns which were to be device electrodes 2, 3 and a gap between the device electrodes L were formed with a photoresist (RD-2000N prepared by Hitachi Chemical Product, Co., Ltd.), and a Ti film 5 nm thick and an Ni film 100 nm thick were sequentially deposited on the soda lime glass substrate 1 on which the oxynitride glass layer 15 and the silica layer 16 were formed. The device electrodes 2 and 3 which had a width W of 300 $\mu$m were formed by dissolving the photoresist with an organic solvent, lifting off the Ni/Ti deposit layer and reserving a gaps L of 3 $\mu$m between the device electrodes (FIG. 22B).

Step-c

A Cr film 100 nm thick was deposited by vacuum deposition and patterned so as to have an opening corresponding to a shape of an electrically conductive layer described later, and a solution of organic palladium (ccp4230 prepared by Okuno Pharmaceutical, Co., Ltd.) to the Cr film with a spinner and baking for 12 minutes by heating at 300° C. An electrically conductive film 4 composed mainly of Pd had a thickness of 10 nm and a sheet resistance value of $2\times10^4\Omega/\square$.

Step-d

Figure 22C:
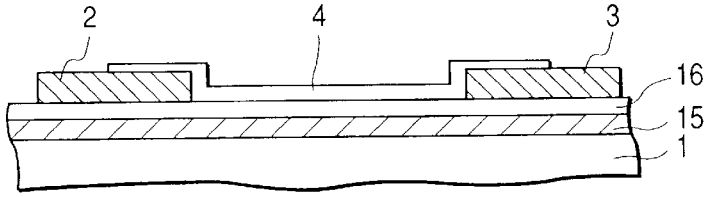

By etching the Cr film and the baked electrically conductive film 4 with an acid etchant, an electrically conductive film which has a desired pattern was formed (FIG. 22C).

By the steps described above, the oxynitride glass layer 15, the silica layer 16 and the device electrodes 2, 3 were formed on the substrate 1.

Step-e

Figure 22D:
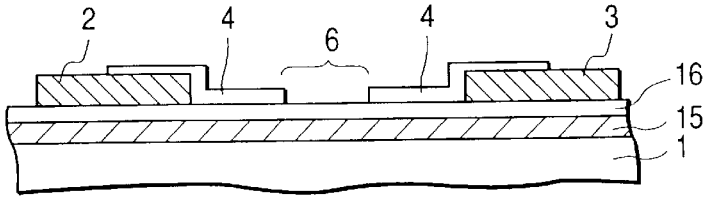

After placing the substrate in the measurement-evaluation apparatus shown in FIG. 6 and evacuating the vacuum chamber to a vacuum degree of $1.3\times10^{-6}$ Pa with a vacuum pump, the forming treatment was conducted by applying a voltage across the device electrodes 2 and 3 from the power source 61 which is provided to apply the device voltage Vf to the element. The voltage applied for the forming treatment had the waveform shown in FIG. 7B. The second gap 6 was formed by this step (FIG. 22D).

The forming treatment was carried out by increasing a crest value of a rectangular wave at 0.1 V steps with T1 and T2 which are the pulse width and a pulse interval of the voltage waveform shown in FIG. 7B set at 1 msec and 10 msec respectively. During the forming treatment, resistance was measured by inserting a resistance measuring pulse between the forming pulses at a voltage of 0.1 V. The forming treatment was terminated together with the voltage application to the device when a valued measured with the resistance measuring pulse exceeded approximately 1 M$\Omega$.

Step-f

Figure 22E:
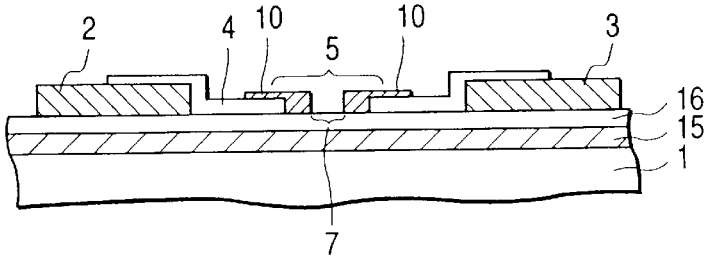

Successively, benzonitrile was introduced into the vacuum chamber through a slow leak valve and a vacuum pressure was maintained at $1.3\times10^{-4}$ Pa for the activation step. Then, the activation treatment was conducted on the device which was subjected to the forming treatment with a crest value set at 14 V for the waveform shown in FIG. 13. Speaking concretely, a pulse voltage was applied across the device electrodes while measuring the device current If in the measurement-evaluation apparatus. Since the If value was nearly saturated in about 15 minutes, the voltage application was terminated and the slow leak valve was closed to terminate the activation treatment. The carbon film 10 and the first gap 7 were formed at the same time by this step (FIG. 22E).

Step-g

A stabilization step was conducted successively. The vacuum chamber was evacuated continuously while heating and maintaining the vacuum chamber and the electron-emitting device at about 250° C. with a heater. An internal pressure of the vacuum chamber reached a level on the order of $6.7\times10^{-8}$ Pa when the heating was stopped 20 hours later and the vacuum chamber was cooled to room temperature.

Successively, electron emission characteristics were measured as in Example 1.

With a distance H at 4 mm between the anode 64 and the electron-emitting device, the anode 64 was set at a potential of 1 kV with the high voltage power source 63. In this condition, a rectangular pulse voltage was applied across the device electrodes 2 and 3 from the power source 61, and the device current If and the emission current Ie of the device in Example 2 and the device in the comparative example were measured with the ammeter 60 and the ammeter 62.

The device in Example 2 exhibited the device current If=8.0 mA, the emission current Ie=18.5 $\mu$A and the electron emission efficiency $\eta$ (=Ie/If)=0.23%. The device in the comparative example exhibited the device current If=4.0 mA, the emission current Ie=8.0 $\mu$A and the electron emission efficiency $\eta$ (=Ie/If)=0.20%.

When the device current If and the emission current Ie were measured once again after allowing the device to emit electrons continuously for a definite time, the device in Example 2 exhibited the device current If=8.0 mA, the emission current Ie=18.5 $\mu$A and the electron emission efficiency $\eta$ (=Ie/If)=0.23% which remained unchanged, whereas the device in the comparative example exhibited the device current If=3.5 mA, the electron emission current Ie=7.5 $\mu$A and the electron emission efficiency $\eta$ (=Ie/If)=0.21%.

These results indicated that the device in Example 2 not only provides the electron emission current Ie higher than the device in the comparative example but also has a higher stability during its driving.

EXAMPLE 3

In Example 3, a glass material which has a high strain point (550° C. or higher) which was obtained by substituting nearly half an amount of Na for K in soda lime glass was used in place of the substrate 1 in Example 1. Also in a comparative example, a device was formed on this glass material. A manufacturing method and a configuration of devices remained unchanged from those in Example 1, except for the points which are described above.

The device in Example 3 exhibited the device current If=5.5 mA, the electron emission current Ie=12.6 $\mu$A and the electron emission efficiency $\eta$ (=Ie/If)=0.23%. The device in the comparative example has the device current If=2.5 MA, the emission current Ie=5.0 $\mu$A and the electron emission efficiency $\eta$ (iE/iF)=0.20%.

When the device current If and the emission current Ie were measured once again after allowing the device to emit electrons for a definite time, the device in Example 3 exhibited the device current If=5.5 mA, the emission current Ie=12.6 $\mu$A and the electron emission efficiency $\eta$ (=Ie/If)=0.23%, whereas the device in the comparative example had the device current If=2.0 mA, the emission current Ie=4.5 $\mu$A and the electron emission efficiency $\eta$ (=Ie/If)=0.23%. These results clarified that the device in Example 3 not only provides the emission current Ie which is higher that of the device in the comparative example but also has a higher stability while it is driven.

EXAMPLE 4

In Example 4, an SiON (33 atom % of Si: 57 atom % of O: 10 atom % of N) layer 1 $\mu$m thick was formed on the substrate 1 which was used in Example 3 by solgel method. A configuration and a manufacturing method of a device remained unchanged from those in example 3, except for a point which is described above.

The device in Example 4 exhibited the device current If=6.5 mA, the emission current Ie=15.0 $\mu$A and the electron emission efficiency $\eta$ (=Ie/If)=0.23%.

When the device current If and the emission current Ie were measured once again after allowing the device to emit electrons continuously for a definite time, the device in Example 4 exhibited the device current If=6.5 mA, the emission current Ie=15.0 $\mu$A and the electron emission efficiency $\eta$ (=Ie/If)=0.23% which remained unchanged.

These result indicates that the device in example 4 not only provides the emission current Ie which is high but also has excellent stability during drive.

EXAMPLE 5

Manufactured in Example 5 was an image forming apparatus in which a large number of surface conduction type electron-emitting devices are arranged in a simple matrix.

Figure 14:
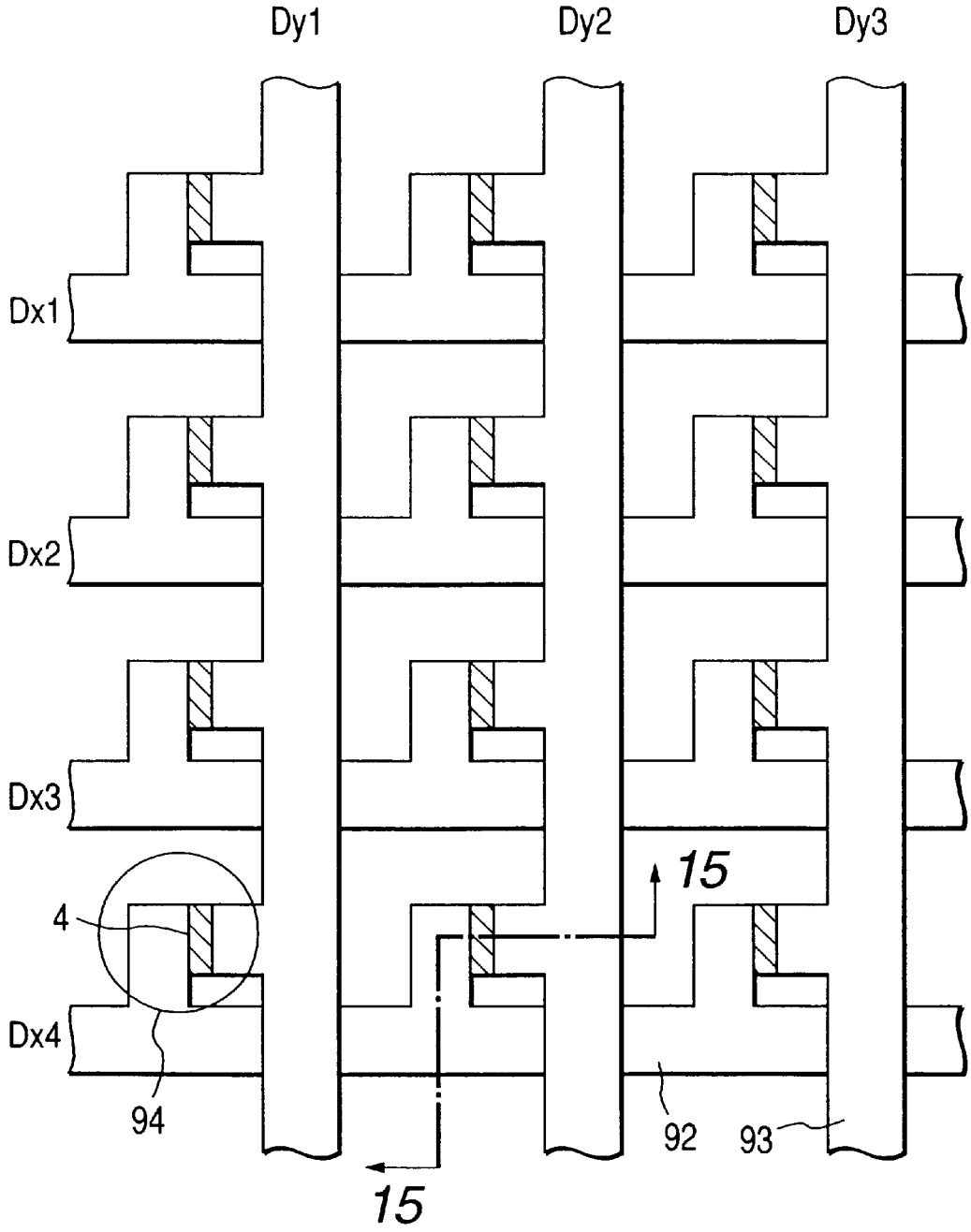
FIG. 14 is a partial diagram illustrating a configuration of a second embodiment of the electron source according to the present invention.
Figure 15:
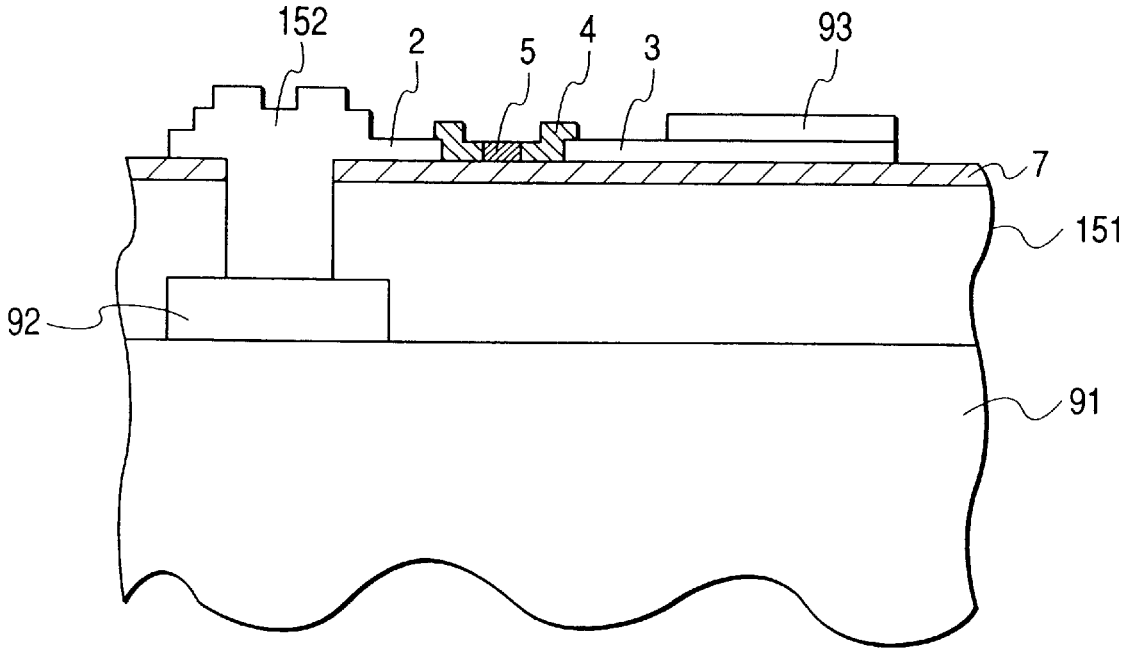
FIG. 15 is a sectional view taken along a line 15—15 in FIG. 14.

FIG. 14 is a partial plan view of an electron source. FIG. 15 is a sectional view taken along a 15—15 line in FIG. 14. The same members are denoted by the same reference numerals in FIGS. 14 and 15. In FIGS. 14 and 15, a reference numeral 91 denotes a substrate, a reference numeral 92 denote a wire in the X direction referred to also as a lower wire) corresponding to the DXm in FIG. 9, a reference numeral 93 denotes a wire in the Y direction (referred to also as an upper wire) corresponding to the Dyn in FIG. 9, a reference numeral 4 denotes an electrically conductive film, a reference numeral 23 denotes a device electrode, a reference numeral 7 denotes a silica layer, a reference numeral 151 denotes an insulating layer between layers which is made of oxynitride glass, and a reference numeral 152 denotes a contact hole for electrical connection between a device electrode 2 and the lower wire 92.

Then, a manufacturing method will be described in a sequence of steps with reference to FIGS. 16A through 16D and 17A through 17D.

Step-a

Figure 16A:
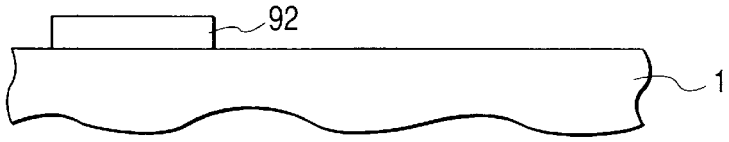
FIGS. 16A, 16B, 16C and 16D are diagrams descriptive of manufacturing processes of the second embodiment of the electron source according to the present invention.

After forming a Cr film 5 nm thick and an Au film 0.6 $\mu$m thick on a cleaned soda lime glass substrate 1 by vacuum deposition, photoresist (AZ 1370 manufactured by Hoechst, Co., Ltd.) was coated with a spinner and baked, a resist pattern of the lower wire was formed by exposing and developing an image of a photomask and the lower wire 92 having a desired shape was formed by wetetching the deposit layer of Au/Cr (FIG. 16A).

Figure 16B:
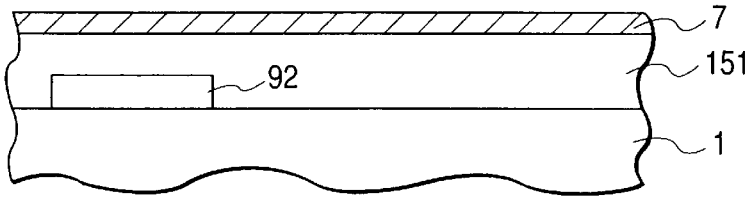

Step-b Then, the insulating layer 151 1.0 μm thick between layers which was made of oxynitride glass was deposited by the sol-gel method. Furthermore, the silica layer 80 nm thick was formed by the RF sputtering method (FIG. 16B). The insulating layer 151 between layers serves like the oxynitride glass layer 6.

Step-c

Figure 16C:
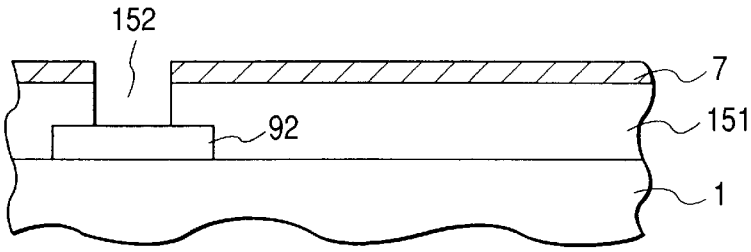

A photoresist pattern was formed to form the contact hole 152 in the insulating layer 151 between layers and the silica layer 7, and the contact hole 152 was formed by etching the insulating layer 151 between layers and the silica layer 7 using the photoresist pattern as a mask (FIG. 16C).

Step-d

Figure 16D:
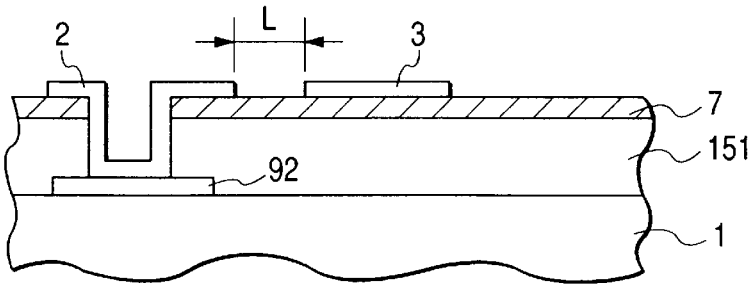

Then, a pattern which was to be used as a gap L between the device electrode 2 and the device electrode 3 was formed with photoresist (RD-2000N-41 prepared by Hitachi Chemical Product, Co., Ltd.), and Ti layer 5 nm thick and a Ni layer 0.1 μm thick were sequentially deposited by the vacuum deposition method. The device electrodes 2 and 3 which had a width W of 0.3 mm were formed with the gap L=3 μm reserved between the device electrodes by dissolving the photoresist patterns with an organic solvent and lifting off the Ni/Ti layer (FIG. 16D).

Step-e

Figure 17A:
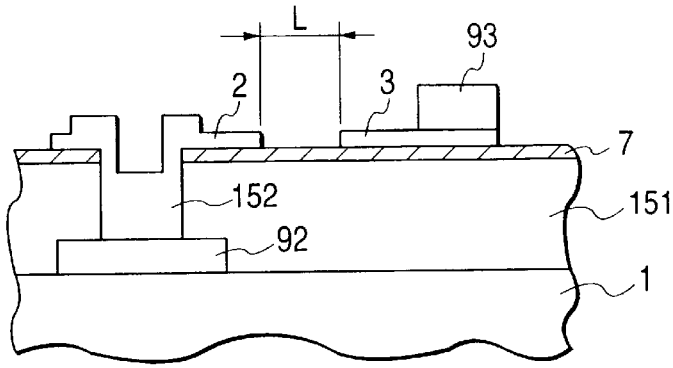
FIGS. 17A, 17B, 17C and 17D are diagrams descriptive of the manufacturing processes of:the second embodiment of the electron source according to the present invention.

After forming a photoresist pattern of the upper wire 93 on the device electrodes 2 and 3, a Ti film 5 nm thick and an Au film 0.5 μm thick were deposited sequentially by vacuum deposition, and the upper wire 93 having a desired shape was formed by lifting of unwanted portions (FIG. 17A).

Step-f

Figure 17B:
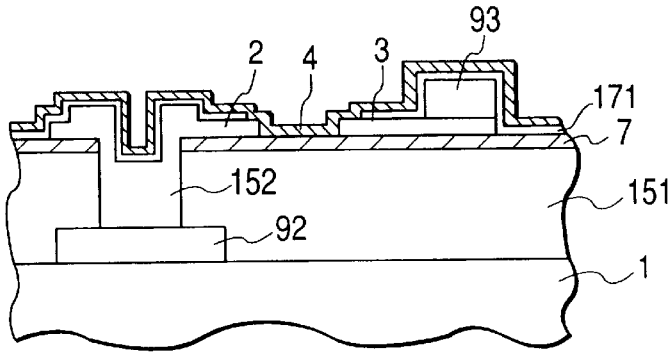

After depositing and patterning a Cr film 171 0.1 μm thick by vacuum deposition, a solution of an organic palladium compound (ccp4230 prepared by Okuno Pharmaceutical, Co., Ltd.) was coated over the Cr film with a spinner and baked for 10 minutes while heating at 300° C. (FIG. 17B). The electrically conductive thin film 4 composed mainly of Pd which was formed as described above had a thickness of 10 nm and a sheet resistance value of $2\times10^4\Omega/\square$.

Step-g

Figure 17C:
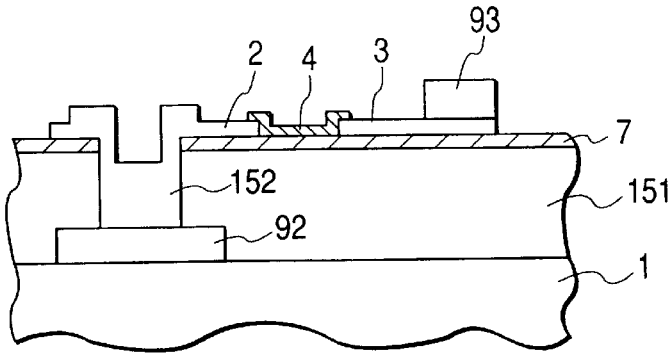

A desired pattern was formed by etching the Cr film 171 and the baked electrically conductive thin film 4 with an acid etchant (FIG. 17C).

Step-h

Figure 17D:
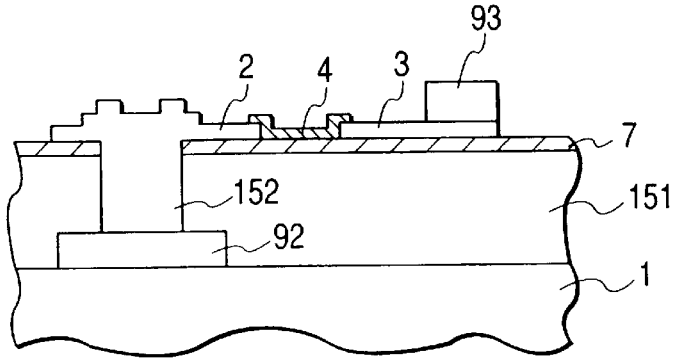
Figure 18A:
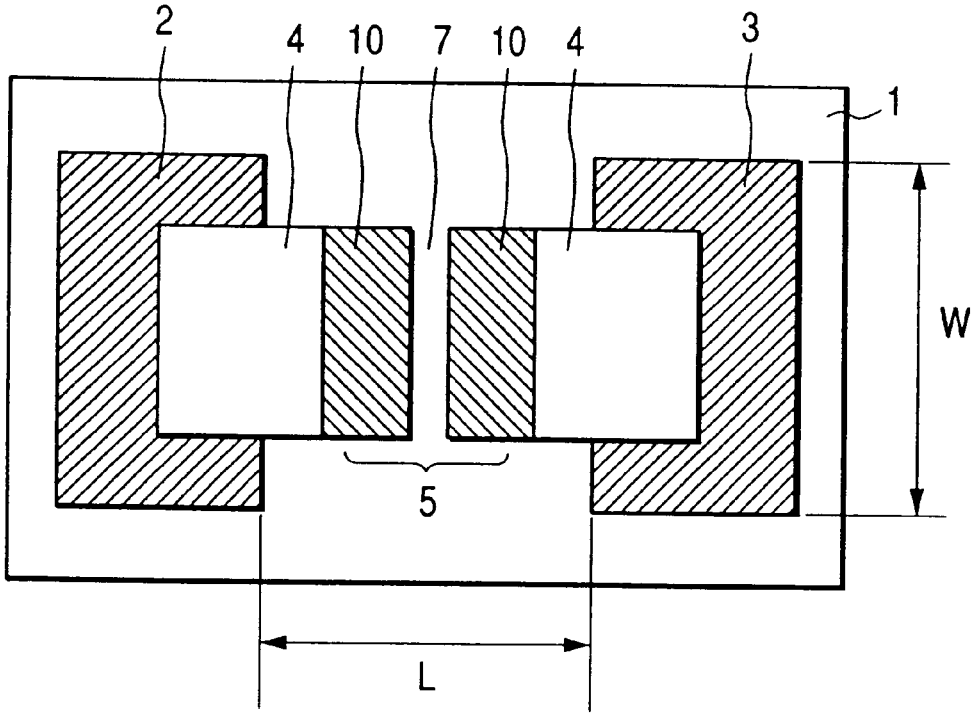
FIG. 18A PRIOR ART
FIGS. 18A and 18B are diagrams showing a configuration of a conventional surface conduction type electron-emitting device.
Figure 18B:
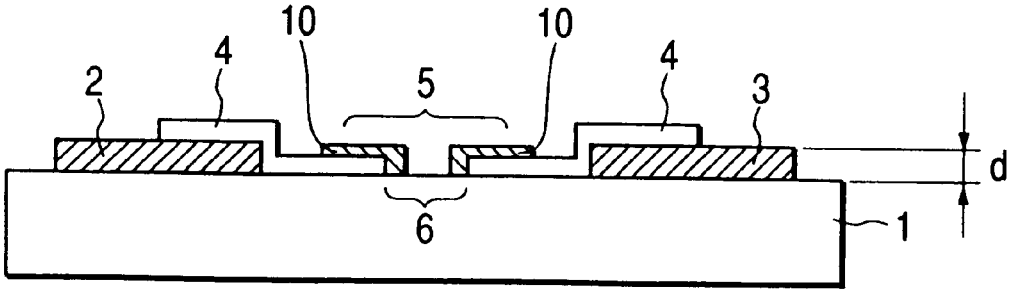
FIG. 18B PRIOR ART

After forming a pattern to coat resist to surfaces other than the contact hole 152, a Ti film 5 nm thick and an Au film 0.5 μm thick were deposited sequentially by vacuum deposition. The contact hole 152 was embedded by removing unwanted portions (FIG. 17D).

The lower wire 92, the insulating layer 151 between layers which was composed of oxynitride glass, the silica layer 7, the upper wire 93, the device electrodes 2 and 3, and the electrically conductive thin film 4 were formed by the steps described above.

Now, description will be made of a display apparatus which is composed using the electron source manufactured as described above by using FIG. 9 and FIG. 10.

After fixing the substrate 1 on which a large number of planar surface conduction type electron-emitting devices are formed as described above onto the rear plate 10, the face plate 106 (the fluorescent film 104 and the metal back 105 formed on the inside surface of the glass substrate 103) was disposed 5 mm over the substrate 1 by way of the support frame 102, and then frit glass was coated to bonds of the face plate 106, the support frame 102 and the rear plate 101 and calcined in an atmosphere at 400° C. for 10 minutes for sealing (FIG. 10). Furthermore, the substrate was fixed to the rear plate 101 also with frit glass.

In FIG. 10, a reference numeral 94 denotes an electron-emitting device before formation of the electron-emitting region (corresponding to FIG. 5C for example), and the reference numeral 92 and 93 denote element wires in the X direction and the Y direction respectively.

Though the fluorescent film 104 is composed only of a fluorescent substance in case of a monochromatic system, a fluorescent substance which has a stripe shape was adopted, black stripes were formed first and the fluorescent film 104 was formed by applying fluorescent substances of different colors between the black stripes in Example 5. A material having a main component of graphite conventionally used was selected as a material for the black stripes. The fluorescent substances are coated to the glass substrate 103 by a slurry method.

Furthermore, the metal back 105 is usually disposed on an inside surface of the fluorescent film 104. The metal back was manufactured by performing a smoothing treatment (generally referred to as filming) of the inside surface of the fluorescent film and then vacuum deposition of Al after forming the fluorescent film.

With respect to a face plate 106, a transparent film (not shown) may be disposed on an outside surface of the fluorescent film 94 to further enhance conductivity of the fluorescent film 104 but was not used in Example 5 wherein a sufficient conductivity was obtained with the metal back only.

The members were sufficiently positioned at the step of the sealing since the color fluorescent substances must precisely correspond to the electron-emitting devices in a color display system.

After evacuating the glass vessel completed as described above to a sufficiently high vacuum degree by exhausting its internal atmosphere through an exhaust pipe (not shown), forming treatment of the electrically conductive thin film 4 was conducted by applying a voltage across the electrodes 2 and 3 of the electron-emitting devices 94 by way of the external terminals Dox1 through Doxm and Doy through Doyn of the vessel. A voltage waveform for the forming treatment was the same as that shown in FIG. 7B.

In Example 5, the forming treatment was conducted in a vacuum atmosphere of approximately $1.3\times10^{-2}$ Pa with T1 and T2 set at 1 msec and 10 msec respectively.

After continuing the evacuation until an internal pressure of the panel reached $1.3\times10^{-6}$ Pa, benzonitrile was introduced into the panel through an exhaust pipe of the panel until a total pressure reached $1.3\times10^{-4}$ Pa and the panel was maintained at this pressure. The activation treatment was conducted by applying a voltage having the waveform shown in FIG. 13 with a crest value of 15 V across the electrodes 2 and 3 of the electron-emitting device 94 by way of the external terminals Dox1 through Doxm and Doy1 through Doyn of the vessel.

The electron-emitting device 94 having the electron-emitting region 5 was manufactured by conducting the forming treatment and the activation treatment as described above.

Then, the enclosure was sealed by heating an exhaust pipe (not shown) with a gas burner after evacuating the panel while heating it to 250° C. as a whole and setting an internal pressure to a level on the order of $1.3\times10^{-7}$ Pa by cooling the panel to room temperature.

Finally the getter treatment was conducted with a high-frequency heating method to maintain a pressure after the sealing.

The image forming apparatus according to the present invention which is completed as described above was allowed to display an image by applying a scanning signal and a modulation signal from a signal generating means (not shown) to the electron-emitting devices by way of the external terminals Dx1 through Dxm and Dy1 through Dyn of the vessel to allow the electron-emitting devices to emit electrons, and applying a high voltage of 5 kV or higher to the metal back 105 or the transparent electrode (not shown) by way of the high voltage terminal 107 to accelerate and impinge an electron beam to the fluorescent film 104, thereby exciting and glowing the fluorescent film 104.

The image forming apparatus manufactured in Example 5 was capable of stably displaying favorable images at luminance sufficiently satisfactory as TV images (about 150 fL), with a high uniformity and for a long time.

EXAMPLE 6

Example 6 exemplifies a display apparatus which is configured to be capable of displaying image data provided from a TV broadcasting station and other various image data sources. The image forming apparatus manufactured in Example 5 (FIG. 10) was operated with the driving circuit shown in FIG. 12 to display images according to TV signals in the NTSC mode.

The display apparatus facilitates to thin a display panel which uses surface conduction type electron-emitting devices as an electron beam source in particular, the apparatus can have a short depth. In addition, the display apparatus is capable of images which are full of realities and impressive forces with a high legibility since the display panel which uses the surface conduction type electron-emitting devices as the electron source can easily enlarged, and has high luminance and a large angle of view.

The display apparatus manufactured in example 6 was capable of displaying TV images formed according to TV signals in the NTSC mode with high uniformity and high stability for a long time.

As understood from the foregoing description, the present invention makes it possible to suppress the influences on an electron emission characteristic which are assumed due to the activation step of the surface conduction type electron-emitting devices and heat generation during drive of the devices by forming oxynitride glass layer which is thermally stable on a surface of a substrate. Simultaneously, the present invention makes it possible to prevent sodium ions contained in the substrate from dispersing into the elements. As a result, the present invention is capable of providing an electron-emitting device which has a favorable and stable electron emission characteristic for a long time.

Furthermore, the present invention is capable of providing an electron source in which electron-emitting devices have a highly uniform and favorable electron emission characteristic for a long time by composing the electron source of the electron-emitting device in a plurality on a substrate, arranging the devices which have ends connected to wires in a plurality of rows, and adopting a configuration for the electron source in which modulation means is disposed or a configuration which comprises a plurality of electron-emitting devices having pairs electrodes connected to a substrate or m wires in an X direction and n wires in a Y direction which are electrically insulated from one another.

Furthermore, the present invention makes it possible to enhance a stability of an electron emission characteristic and prolong a life of an image forming apparatus by composing the apparatus of an image forming member and the electron-emitting devices or to configure an image forming apparatus, for example a color flat TV which forms high definition images with high uniformity using a fluorescent substance as an image forming member.

What is claimed is:

1. An electron-emitting device comprising:

a substrate;

a layer disposed on said substrate;

first and second carbon films disposed on said layer; and first and second electrodes electrically connected to said first and second carbon films, respectively, wherein said first and second carbon films are opposed to each other with a first gap interposed therebetween, wherein said layer comprises at least Si, O and N, and wherein a percentage content of N in said layer is less than 10 atm. %.

2. The electron-emitting device according to claim 1, wherein said layer comprises a compound of Si, O and N.

3. The electron-emitting device according to claim 2, wherein the compound is oxynitride glass.

4. The electron-emitting device according to claim 3, further comprising a further layer having a main component of silica, wherein said layer having a main component of silica is disposed between said layer comprising the compound of oxynitride glass and said first and second carbon films.

5. The electron-emitting device according to claim 4, wherein said layer having the main component of silica comprises phosphorus.

6. The electron-emitting device according to claim 4, wherein said layer having the main component of silica has a thickness of 40 nm or larger.

7. The electron-emitting device according to claim 4, wherein said layer composed of oxynitride glass has a thickness of 1 $\mu$m or larger.

8. An electron source comprising a plurality of electron-emitting devices disposed on a substrate, wherein each electron-emitting device is the electron-emitting device according to claim 4.

9. An image forming apparatus comprising:

an electron source; and an image forming member, wherein said electron source is the electron source as claimed in claim 8.

10. The electron source according to claim 8, further comprising m wires in an X direction and n wires in a Y direction which are electrically insulated from one another and disposed on said substrate, wherein said first and second electrodes are electrically connected to said wires in the X direction and the Y direction, respectively.

11. An image forming apparatus comprising:

an electron source; and an image forming member, wherein said electron source is the electron source as claimed in claim 10.

* * * * *

UNITED STATES PATENT AND TRADEMARK OFFICE

CERTIFICATE OF CORRECTION

PATENT NO. : 6,522,054 B2
DATED : February 18, 2003
INVENTOR(S) : Masaaki Shibata It is certified that error appears in the above-identified patent and that said Letters Patent is hereby corrected as shown below:

Column 1,
Line 34, "An." should read -- An --.

Column 4,
Line 60, "in" should be deleted.

Column 5,
Line 7, "of:the" should read -- of the --;
Line 54, "separated" should read -- be separated --;
Lines 46 and 56, "gaps" should read -- gap --.

Column 7,
Line 55, "exhibits" should read -- exhibit --.

Column 12,
Line 23, "adopts" should read -- adopt --.

Column 13,
Line 9, "increased." should read -- increases. --.

Column 15,
Line 12, "there by" should read -- thereby --;
Line 65, "A" should read -- Al --; and
Line 66, "e" (third occurrence) should be deleted.

Column 16,
Line 9, "t" should be deleted.

Column 18,
Line 10, "charge s" should read -- charges --.

Column 21,
Line 2, "rom" should read -- room --.

UNITED STATES PATENT AND TRADEMARK OFFICE

CERTIFICATE OF CORRECTION

PATENT NO. : 6,522,054 B2
DATED : February 18, 2003
INVENTOR(S) : Masaaki Shibata It is certified that error appears in the above-identified patent and that said Letters Patent is hereby corrected as shown below:

Column 24,
Line 66, "wetetching" should read -- wet-etching --.

Column 27,
Line 65, "pairs" should read -- pairs of --.

Signed and Sealed this

Eighteenth Day of November, 2003

JAMES E. ROGAN
*Director of the United States Patent and Trademark Office*